US007776163B2

(12) United States Patent
Xu et al.

(10) Patent No.: US 7,776,163 B2
(45) Date of Patent: Aug. 17, 2010

(54) LEAD-FREE FREE-CUTTING ALUMINUM BRASS ALLOY AND ITS MANUFACTURING METHOD

(75) Inventors: Chuankai Xu, Xiamen (CN); Zhenqing Hu, Xiamen (CN); Siqi Zhang, Changsha (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 12/643,513

(22) Filed: Dec. 21, 2009

(65) Prior Publication Data

US 2010/0158748 A1 Jun. 24, 2010

(30) Foreign Application Priority Data

Dec. 23, 2008 (CN) ..... 2008 1 0188263

(51) Int. Cl.
*C22C 9/04* (2006.01)
*C21F 1/08* (2006.01)

(52) U.S. Cl. ..... 148/433; 420/471; 420/472; 420/476; 420/499; 148/679; 148/553

(58) Field of Classification Search ..... 148/433, 148/434, 436, 679, 553; 420/471, 472, 476, 420/478, 499

See application file for complete search history.

(56) References Cited

U.S. PATENT DOCUMENTS

| | | | | |
|---|---|---|---|---|
| 2,061,921 | A | | 11/1936 | Roath |
| 2,237,774 | A | | 4/1941 | Wood |
| 3,988,176 | A | | 10/1976 | Watanabe et al. |
| 4,233,068 | A | | 11/1980 | Smith, Jr. et al. |
| 4,452,757 | A | | 6/1984 | Kawauchi et al. |
| 4,592,781 | A | | 6/1986 | Cheney et al. |
| 4,935,076 | A | | 6/1990 | Yamaguchi et al. |
| 4,965,045 | A | | 10/1990 | Giarda et al. |
| 5,000,915 | A | | 3/1991 | Shirosaki et al. |
| 5,069,874 | A | | 12/1991 | Shirosaki et al. |
| 5,630,984 | A | * | 5/1997 | Waschke et al. ..... 420/478 |
| 5,658,401 | A | | 8/1997 | Gaag et al. |
| 6,699,337 | B2 | | 3/2004 | Hatakeyama et al. |

(Continued)

FOREIGN PATENT DOCUMENTS

CN 1461815 A 12/2003

(Continued)

*Primary Examiner*—Roy King
*Assistant Examiner*—Janelle Morillo
(74) *Attorney, Agent, or Firm*—McDermott Will & Emery LLP

(57) ABSTRACT

The present invention provides a lead-free free-cutting aluminum brass alloy and its manufacturing method. The alloy comprises: 57.0~63.0 wt % Cu, 0.3~0.7 wt % Al, 0.1~0.5 wt % Bi, 0.2~0.4 wt % Sn, 0.1~0.5 wt % Si, 0.01~0.15 wt % P, at least two elements selected from the group of 0.01-0.15 wt % Mg, 0.0016-0.0020 wt % B, and 0.001-0.05 wt % rare earth elements and the balance being Zn and unavoidable impurities. The inventive alloy has excellent castability, weldability, cuttability and corrosion resistance. It is suitable for low pressure die casting, gravity casting, horizontal continuous casting, forging and extrusion. Its metal material cost is lower than bismuth brass. It is particularly applicable for components used in drinking water supply systems and other structural components. It is a new environmentally-friendly free-cutting aluminum brass alloy.

9 Claims, 24 Drawing Sheets

U.S. PATENT DOCUMENTS

| | | | | |
|---|---|---|---|---|
| 6,933,054 | B2 | 8/2005 | Ohla et al. | |
| 6,942,742 | B2 * | 9/2005 | Yamagishi | 148/433 |
| 6,949,150 | B2 | 9/2005 | Sugawara et al. | |
| 7,338,631 | B2 | 3/2008 | Ishida et al. | |
| 7,354,489 | B2 | 4/2008 | Hofmann et al. | |
| 2004/0234412 | A1 | 11/2004 | Oishi et al. | |
| 2006/0289094 | A1 | 12/2006 | Zhang et al. | |
| 2008/0000444 | A1 | 1/2008 | Hofmann et al. | |
| 2008/0240973 | A1 | 10/2008 | Gaag et al. | |
| 2009/0022620 | A1 | 1/2009 | Weber | |
| 2009/0263272 | A1 | 10/2009 | Uchida | |

FOREIGN PATENT DOCUMENTS

| | | | |
|---|---|---|---|
| CN | 101363086 | A | 2/2009 |
| DE | 10132055 | A1 | 1/2003 |
| DE | 10159949 | C1 | 5/2003 |
| DE | 10308779 | B3 | 11/2004 |
| DE | 102004013181 | B3 | 9/2005 |
| DE | 102004012386 | A1 | 10/2005 |
| DE | 112004002639 | T5 | 11/2006 |
| DE | 102005059391 | A1 | 6/2007 |
| EP | 0145612 | A1 | 6/1985 |
| EP | 1273671 | A1 | 1/2003 |
| EP | 1441040 | A1 | 7/2004 |
| EP | 1528229 | A1 | 5/2005 |
| EP | 1777306 | A1 | 4/2007 |
| GB | 2359862 | A | 9/2001 |
| JP | 57194234 | A | 11/1982 |
| JP | 57194235 | A | 11/1982 |
| WO | WO 2005106374 | A1 | 11/2005 |
| WO | WO 2007043101 | A1 | 4/2007 |
| WO | WO 2008041777 | A1 | 4/2008 |
| WO | WO 2009019990 | A1 | 2/2009 |
| WO | WO 2009051254 | A1 | 4/2009 |

* cited by examiner

LEAD-FREE FREE-CUTTING ALUMINUM BRASS ALLOY AND ITS MANUFACTURING METHOD

FIELD OF THE INVENTION

The present invention generally relates to a lead-free free-cutting aluminum brass alloy, in particular a lead-free free-cutting aluminum brass alloy and its manufacturing method which is applicable in low pressure die castings and forgings.

BACKGROUND OF THE INVENTION

Currently, when people search and develop lead-free or low lead free-cutting brass alloys, they typically follow two routes to find the elements which could replace Lead: one route is to select the elements which hardly form solid solutions in Cu and can't form intermetallic compounds with Cu, such as Bi, Se and Te, etc; the other route is to select the elements which will form solid solutions in Cu wherein the solid solubility is reduced with decreasing temperature, so as to form intermetallic compounds with Cu, and with Sb, P, Mg, Si, B and Ca, etc. The first route has been well-known for some time. The second route is a more recent development.

In the process of researching and developing, considering the process properties, and comparing properties versus market cost requirements, the selection of elements for an alloy, and their range, will vary. Therefore, varied lead-free free-cutting brass alloys have been invented The bismuth brass alloy invention is the most common of these alloys.

For example, Pub. No. CN101225487A to Xuhong Hu discloses an arsenic-containing low-lead brass alloy which comprises (wt %) 57-62 Cu, 36-43 Zn, 0.01-1.0 Al, 0.05-2.5 Bi, 0.005-0.3 As, ≦0.2 Pb and ≦0.65 Sn, wherein small amounts of Ni, Fe and S and minimum amounts of Si, Mg, Mn and Re (Rhenium) are selectively added. No P is added. Arsenic is one of the main elements of such an alloy. If its As content is in the middle to upper limits of the above-specified range, and if the content of Pb is in the range of 0.1-0.2 wt %, then both As and Pb are released into the water in amounts that will exceed the upper limits of the NSF standard. Therefore, such brass alloys cannot be used in the components for drinking water supply systems, such as faucets and valves.

Pat. No. CN1045316C to Kohler discloses a low-lead bismuth brass alloy which comprises (wt %) 55-70 Cu, 30-45 Zn, 0.2-1.5 Al, 0.2-0.3 Bi, ≦1.0 Pb, ≦2.0 Ni, ≦1.0 Fe, ≦0.25 In, and 0.005-0.3 Ag, further comprising minimal amounts of one or more of the elements Ta, Ga, V, B, Mo, Nb, Co, and Ti. Zr is selectively added. No Si or P is added.

Pub. No. CN1710126A to Powerway discloses a lead-free free-cutting low-antimony bismuth brass alloy and its manufacturing method which comprises (wt %) 55-65 Cu, 0.3-1.5 Bi, 0.05-1.0 Sb, 0.0002-0.05 B, wherein elements such as Ti, Ni, Fe, Sn, P and rare earth elements are selectively added and the balance is Zn and impurities. No Si or Al is added. If the content of Sb is ≧0.1, the amount of Sb released in the water will exceed the requirements of the NSF standard.

JP2000-239765A to Joetsu discloses a lead-free brass alloy with corrosion resistance for castings, which comprises (wt %) 64-68 Cu, 1.0-2.0 Bi, 0.3-1.0 Sn, 0.01-0.03 P, 0.5-1.0 Ni, 0.4-0.8 Al, <0.2 Fe and the balance being Zn and impurities. The content of Bi is higher and no Si is added.

With the increasingly extensive application of bismuth brasses, their negative effects are also increasingly notable, such as susceptibility to hot and cold cracking, poor weldability, the necessity to slowly heat and cool when annealing, etc. The cause of these negative effects has a common thermodynamic reason: the large differential between the surface tension of bismuth (350 dyne/cm) and that of copper (1300 dyne/cm), and the fact that bismuth cannot form a solid solution in copper and cannot form intermetallic compounds with copper. As a result, liquid bismuth has good wetting with α and β grains of copper and brass. The dihedral angle between bismuth and copper or brass tends to zero. After solidification, bismuth is distributed in the grain boundary in the form of a continuous film.

Nowadays, the developed bismuth brasses are mainly deformation alloys and comprise more than 0.5 wt % bismuth. The public casting bismuth brasses, such as C89550 (which comprises 0.6~1.2 wt % Bi), have high tendencies to experience hot cracking during low pressure die casting, and are not easily welded.

Lead-free or low-lead free-cutting antimony brass has excellent castability, weldability, hot working formability, and dezincification corrosion resistance. However, antimony is more toxic than lead. The NSF/ANSI61-2007 standard requires that Sb is released in drinking water in amounts ≦0.6 m/L and that Pb is released in amounts ≦1.5 m/L (NSF61-2005 requires that Pb release is ≦5 μg/L). Antimony brass is not suitable for components used in drinking water supply system.

Lead-free free-cutting silicon brass is a brass which has certain good developing prospects. Currently researched and developed lead-free free-cutting silicon brasses are mainly low-zinc deformation silicon brass. Most of them comprise small amounts of bismuth and the cost of raw material is rather higher.

Aluminum brass has good corrosion resistance, but its cuttability is inadequate. Few patents and other literature exists relating to lead-free free-cutting aluminum brasses. U.S. Pat. No. 3,773,504 (1973) discloses a Cu—Zn—Al—P series alloy having wear resistance. Japanese Patent 2003-253358 discloses a lead-free free-cutting low-zinc aluminum brass (containing vanadium and boron, etc.)

DETAILED DESCRIPTION

Figure 1A:
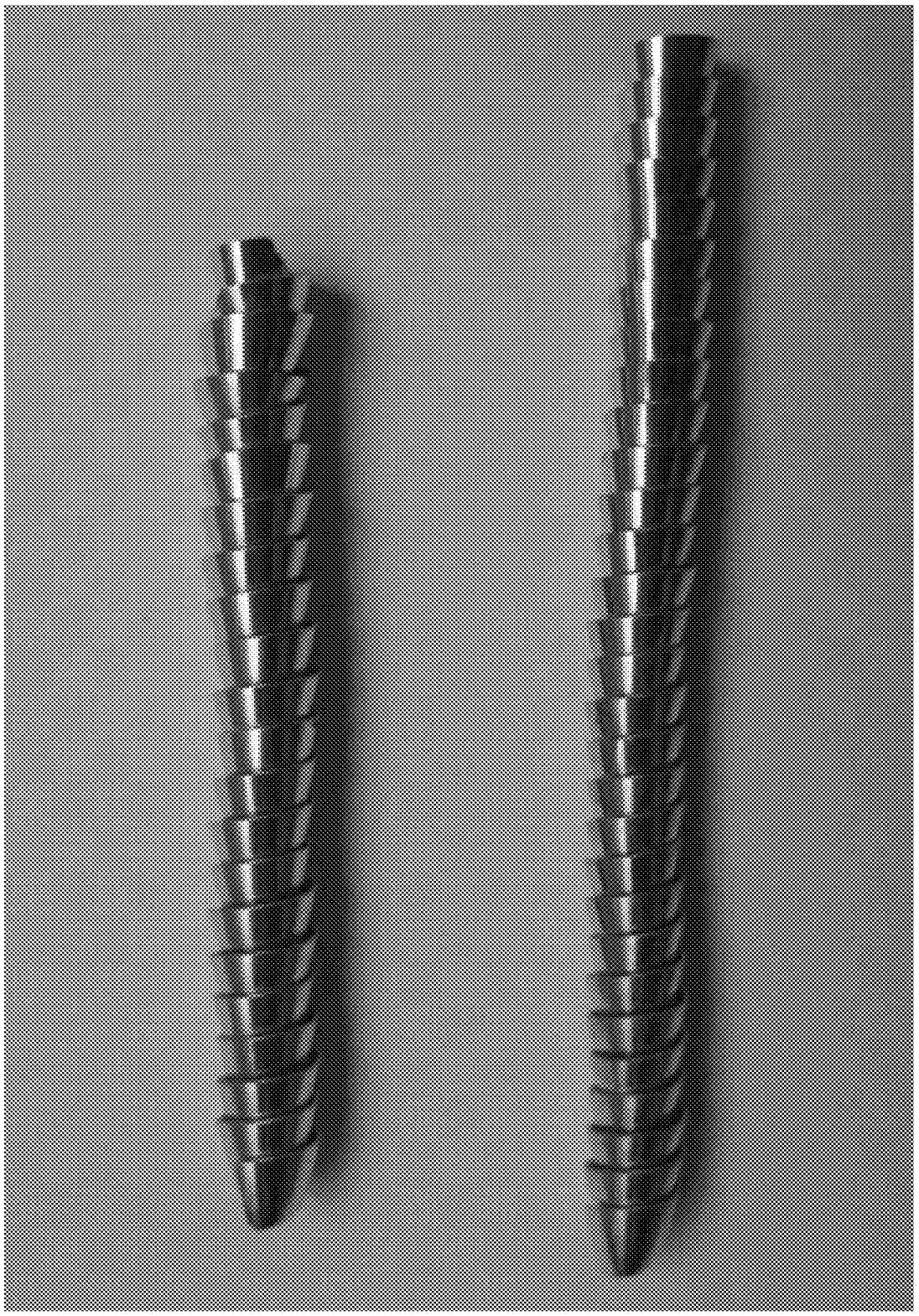
FIGS. 1A, 1B and 1C show the chip shape of example alloy 1 obtained at a cutting speed of 40 m/minute, at feeding quantities of 0.1, 0.2, and 0.3 mm/revolution, respectively.

The object of the present invention is to solve the technical problems of current aluminum brass alloys, including bad cuttability, a tendency of hot cracking and difficulty in welding. The object of the invention also includes the provision of an environment-friendly lead-free free-cutting aluminum brass alloy, which is applicable for low pressure die casting, gravity casting, horizontal continuous casting, forging and welding.

The object of the present invention is realized by selection of the following elements and their composition design. The present invention provides a lead-free free-cutting aluminum brass alloy which comprises (wt %): 57.0~63.0 Cu, 0.3~0.7 Al, 0.1~0.5 Bi, 0.1~0.4 Sn, the balance being zinc and unavoidable impurities. The present invention also provides another alloy which comprises (wt %): 57.0~63.0 Cu, 0.3~0.7 Al, 0.1~0.5 Bi, 0.1~0.5 Si, 0.1~0.4 Sn, 0.01~0.15 P, and which further comprises at least two elements selected from Mg, B and rare earth elements, with the balance being Zn and unavoidable impurities. The at least two selected elements are present in amount of 0.01~0.15 wt % Mg, 0.001~0.05 wt % rare earth elements and 0.0016~0.0020 wt % B.

When bismuth content is in the middle to upper limits of the specified range, α phase and a small amount of β phase dominate the matrix phase of the alloy. When bismuth content is in the lower to middle limits of the specified range, β phase and small amounts of α phase and γ phase dominate the matrix phase of the alloy.

In the inventive alloy, aluminum is the main alloy element, except for zinc. Al can improve corrosion resistance and strength of common brass. During the melting and casting process, bismuth can form compact oxide film for preventing melt oxidation, and for reducing the loss of zinc, which is prone to volatilize and oxidize. However, oxidation characteristics of aluminum are unfavorable for castability and weldability. In addition, aluminum will coarsen the grain of common brass. The zinc equivalent coefficient of aluminum is rather great, and can substantially enlarge the β phase zone. If combined with silicon, aluminum is prone to increase the β phase rate, and promote the formation of the γ phase. Therefore, it is beneficial for improving the cuttability of brass. The surface tension of aluminum (860 dyne/cm) is less than that of copper. It can form solid solutions in copper resulting in decreasing the surface tension of copper. It is favorable for spherifying bismuth, which is distributed in the grain boundary. The surface tension of zinc (760 dyne/cm) is less than that of copper. It can form solid solutions in copper. It is also favorable for spherifying bismuth which is distributed in the grain boundary. In this inventive alloy, aluminum content is lower than common commercialized aluminum brass, and is limited in the range of 0.3~0.7 wt %, more preferably in the range of 0.4~0.6 wt %. Higher aluminum content is not beneficial for castability and weldability.

Bismuth is added to improve the cuttability of aluminum brass. However, as mentioned above, bismuth will increase the hot and cold cracking tendency of copper alloys. The thermodynamic reason for this is the large differential between the surface tension of bismuth and copper, with the result that the dihedral angle between liquid bismuth and solid copper grain tends to be zero. Bismuth will fully wet copper grains. After solidification, bismuth will be distributed in the grain boundary in the form of a continuous film. In order to promote bismuth spheroidization and reduce its unbeneficial effect, the present invention selects the elements which can form solid solutions in copper and decrease the surface tension of copper, such as the above-mentioned main alloy elements, zinc and aluminum. Other optional elements are P, Sn, In, Ga, Ge, Mg, B, Ca, etc. On the other hand, the elements which can form solid solutions in bismuth, and which have surface tension greater than bismuth, such as Pb, Se, Tl, etc, can also promote bismuth spheroidization. The first of the above-mentioned elements, In, Ga and Ge, are very expensive, so only a few bismuth brasses selectively add them. Among the second group of the above-mentioned elements, Pb's pollution to the environment and harmfulness to the human body have been a concern. Selenium and thallium are also toxic. NSF61 standard requires that in drinking water, Se release should be ≦5.0 m/L (equal to Pb) and Tl release should be ≦0.2 m/L (equal to Hg). Ingestion of trace amounts of selenium is not harmful, but in excessive amounts, will damage the skin. Selenium and thallium are also very expensive. In this inventive alloy, selenium and thallium are not added, and thus thallium cannot leach into the water. In this inventive alloy, bismuth content is limited in the range of 0.1~0.5 wt %. Higher bismuth content will not only increase the tendency of hot cracking, which makes castings crack from time to time during low pressure die casting, but also increase cost, reduce corrosion resistance and increase the risk of thallium as an impurity in amounts beyond the standard. The content of Bi is limited in the range of 0.1~0.5 wt %, more preferably in the range of 0.1~0.3 wt %, so that it can achieve castability, weldability, cuttability and low cost.

The effects of Tin mainly include strengthening the solid solution, and improving dezincification corrosion resistance of the alloy. If γ phase is formed in the alloy, small amounts of tin will make γ phase more effectively dispersed, uniformly distributed, and decrease the harmful effects of γ phase on plasticity, and further improve cuttability. The surface tension of tin is 570 dyne/cm. The effect of zinc in promoting bismuth spheroidizing is greater than the spheroidizing effect of zinc and aluminum. Tin content is limited to the range of 0.1~0.4 wt %. Higher content of tin is helpful for bismuth spheroidizing, but cost will increase, and together with silicon and aluminum, more γ phase will be produced resulting in increasing hardness, decreasing plasticity and unbeneficial effects for cutting and forming.

The effects of silicon include improving castability, weldability and corrosion resistance of the alloy, and remarkably enlarging β phase zone. Under certain zinc content, silicon is the main element for adjusting the composition of matrix phase. If there is an appropriate matching ratio among silicon and zinc and aluminum, silicon will promote the formation of γ phase in the alloy and then improve the cuttability. With the increasing of silicon content, γ phase will increase and cuttability will be improved. However, the plasticity will gradually decrease and tendency of hot cracking will increase. It is not beneficial for casting forming, especially for low pressure die casting forming.

In the case that cuttability is guaranteed by bismuth, silicon content is limited in the range of 0.1~0.5 wt %, and is more preferably limited in the range of 0.2~0.5 wt %. When bismuth content is in the middle to upper limits of the specified range and silicon content is in the middle to lower limits of the specified range, the matrix phase of the alloy is α phase and minor amount of β phase.

When bismuth content is in the middle to lower limits of the specified range and silicon content is in the middle to upper limits of the specified range, the matrix phase of the alloy is β phase and minor amount of α phase and γ phase.

Phosphorus is one of the main elements of the alloy. Its effects include deoxidation, improving castability and weldability of the alloy, reducing the oxidation loss of beneficial elements such as aluminum, silicon, tin and bismuth, and refining brass grains. If phosphorus content in the brass exceeds 0.05 wt %, intermetallic compound $Cu_3P$ will be formed. It is beneficial for improving the cuttability of the alloy, but meanwhile, the plasticity will be decreased. Excessive $Cu_3P$ resulting from excessive phosphorus will increase the tendency of hot cracking during low pressure die casting.

In addition, the surface tension of phosphorus is 70 dyne/cm and phosphorus has bigger solid solubility in copper at high temperature; therefore it will obviously decrease the surface tension of copper and improve the effect of bismuth spheroidization. It is a "plasticizer" of bismuth-contained brass.

In the presence of phosphorus, tin, aluminum and zinc, bismuth will be spherically distributed in grain and in grain boundary. It will obviously decrease its unbeneficial influence for cold and hot plasticity and improve castability and weldability. Meanwhile, as bismuth is spherically, uniformly and dispersedly distributed, it is favorable for bismuth to play its beneficial influence on cuttability.

Phosphorus content is limited in the range of 0.01~0.15 wt %. If it is used for horizontal continuous castings or forgings, its content is in the middle to upper limits of the specified range. If it is used for low pressure die casting products (such as the bodies of a faucet), its content is in the middle to lower limits of the specified range.

Magnesium is a selectively added element. Its main effects include further deoxidizing before horizontal continuous casting and preventing castings from cracking during low pressure die casting and welding. If magnesium content exceeds 0.1 wt %, the effect on preventing castings from cracking is still obvious. However, the elongation rate will be decreased. This effect also appears in lead-free free-cutting high-zinc silicon brass. Magnesium also has the effect of grain refinement with the result that bismuth and hard-brittle intermetallic compounds grain is more dispersedly and uniformly distributed and is beneficial for improving cuttability, castability and weldability.

If magnesium content is larger than 0.1 wt %, it will form intermetallic compound $Cu_2Mg$ with copper and is also beneficial for improving cuttability. If magnesium is added, its content is preferably limited in the range of 0.01~0.15 wt %.

The main effect of selectively adding boron and rare earth metal is for grain refinement. The solid solubility of boron in copper is very small, but it will be reduced with the temperature decrease. Precipitated boron also has the effect of improving cuttability. Boron also could suppress dezincification. In addition to grain refinement, rare earth metal also can clean the grain boundary and reduce the unbeneficial effects resulting from the impurities in the grain boundary. Cerium and bismuth can form intermetallic compound BiCe whose melting point reaches up to 1525° C. so that bismuth can enter into the grain boundary in the form of such intermetallic compound. It is favorable for eliminating the hot and cold brittleness caused by bismuth, but meanwhile the contribution of bismuth on cuttability is reduced.

Magnesium, boron, and the rare earth elements are added in small amounts.

In the inventive alloy, lead, iron and antimony may be present as unavoidable impurities, but their content should be limited in the range of ≦0.1 wt %, ≦0.1 wt % and ≦0.03 wt %, respectively. If Pb≧0.2 wt %, Pb released will exceed government standards. If Sb>0.05 wt %, Sb released will exceed the standard. Therefore, the alloy containing such larger content is not applicable for the components used in drinking water systems.

Trace antimony can improve dezincification corrosion resistance of the alloy, like tin and arsenic. In the common casting copper alloys, the allowed iron content is larger than 0.2 wt %. In the inventive alloy, aluminum and silicon are present and iron will form hard-brittle iron-aluminum intermetallic compounds and iron silicide, which will decrease the plasticity, corrosion resistance and castability. In addition, if the hard particles formed by these intermetallic compounds are placed on the surface of the products, after polishing and electroplating, a "hard spots" defect characterized by inconsistent brightness will appear. Any such products must be scrapped.

Alloys containing small amounts of such impurities are beneficial for collocation using lead brass, antimony brass, phosphorus brass, magnesium brass and other old brass materials, saving resource and cost.

The features of selection of the above alloy elements and their composition design include making bismuth be spherically, uniformly and dispersedly distributed in the grain and in the grain boundary, instead of continuous film distribution in the grain boundary. One should generally consider the high standard requirements of processing properties (casting, welding, cutting, plating and etc.). One should also consider using performance criteria (dezincification corrosion, stress corrosion, salt spray corrosion, metal release amount in water, leakage, hardness, strength, elongation rate, consistent brightness on the electroplating surface) and the cost.

The invented alloy and old bismuth brass alloy can be recycled. Lead brass, antimony brass, phosphorus brass, magnesium brass and other old brass materials can be used for saving resources and cost.

The manufacturing method is easily operated, and current lead brass manufacturing equipment can be used.

In order to take all processing properties and using performance into consideration, the volume shrinkage samples should ensure that the surface of concentrating shrinkage cavities is smooth, there is no porosity in depth, the elongation rate of as-cast is larger than 6%, the hardness HRB is in the range of 55~75, and the bending angle of the strip samples is larger than 55°.

The inventive alloy is a new environment-friendly aluminum brass, especially applicable for low pressure die casting or gravity casting or forging products which are subject to cutting and welding, such as components for drinking water supply systems.

The manufacturing method of the inventive alloy is as follows:

Materials proportion—melting in main-frequency induction furnace and being protected by the covering agent—tapping at 1000° C., and pouring to be ingots—remelting—low pressure die casting (980~1000° C.) or horizontal continuous casting (990~1030° C.)~forging (650~710° C.)

EXAMPLES

The alloy composition in examples is shown in Table 1.

TABLE 1

| Alloy composition in examples (wt %) | | | | | | | | | | |
|---|---|---|---|---|---|---|---|---|---|---|
| Examples | Cu | Al | Bi | Sn | Si | Mg | B | Re | P | Zn |
| 1 | 60.13 | 0.52 | 0.48 | 0.275 | 0.12 | — | 0.0017 | 0.005 | 0.0653 | Balance |
| 2 | 58.72 | 0.38 | 0.41 | 0.165 | 0.23 | 0.09 | 0.0016 | — | 0.093 | Balance |
| 3 | 59.60 | 0.49 | 0.30 | 0.133 | 0.182 | 0.07 | 0.0017 | — | 0.0128 | Balance |
| 4 | 61.06 | 0.42 | 0.24 | 0.242 | 0.13 | 0.105 | — | 0.01 | 0.051 | Balance |
| 5 | 61.27 | 0.43 | 0.29 | 0.251 | 0.27 | 0.133 | — | 0.03 | 0.062 | Balance |
| 6 | 60.82 | 0.39 | 0.23 | 0.318 | 0.24 | 0.08 | — | 0.01 | 0.075 | Balance |
| 7 | 60.26 | 0.42 | 0.37 | 0.327 | 0.31 | 0.07 | 0.019 | 0.04 | 0.082 | Balance |

1. Castability

Castability of the inventive alloy is measured by four kinds of common standard test samples for casting alloys.

Volume shrinkage test samples are used for measuring the shrinkage condition. If the face of the concentrating shrinkage cavity is smooth, and there is no visible shrinkage porosity in depth, it will be shown as "O." It indicates the alloy has good fluidity, strong feeding capacity and high casting compactability. If the face of the concentrating shrinkage cavity is smooth but the height of visible shrinkage porosity is less than 3 mm in depth, it indicates castability is good, and will be shown as "Δ." If the face of the concentrating shrinkage cavity is not smooth and the height of visible shrinkage porosity is more than 5 mm in depth, it will be shown as "x." It indicates the alloy has bad fluidity, weak feeding capacity and bad casting compactability. Leakage will appear if water test is done.

Strip samples are used for measuring linear shrinkage rate and bending angle of the alloy. If the bending angle is larger than 55°, it indicates it is excellent. If it is less than 40°, it indicates the plasticity of the alloy is too low and it is poor. If it is larger than 100° and even unpliant, it indicates the plasticity of the alloy is good and is not beneficial for cutting.

Circular samples are used for measuring shrinkage crack resistance of the alloy. If there is no crack, it is rated as excellent, and will be shown as "O." If there is a crack, it is rated as poor, and will be shown as "x."

Spiral samples are used for measuring the melt fluid length and evaluating the fluidity of the alloy.

All samples are hand poured and the pouring temperature is 1000° C. Test results are shown in Table 2.

TABLE 2

| Castability of the examples and comparative alloys | | | | | | | | | | |
|---|---|---|---|---|---|---|---|---|---|---|
| Examples | | 1 | 2 | 3 | 4 | 5 | 6 | 7 | C36000 | CuZn40Pb1Al0.6 |
| Volume shrinkage | | ○ | ○ | ○ | □ | ○ | ○ | ○ | ○ | ○ |
| Linear shrinkage rate/% | | 1.5~1.9 | | | | | | | 1.9~2.1 | 1.7~1.9 |
| Fluid length/mm | | 400~420 | | | | 420~440 | | | 440 | 430 |
| Wall thickness | 2.5 | ○ | ○ | ○ | ○ | ○ | ○ | ○ | ○ | ○ |
| of circular | 3.0 | ○ | ○ | ○ | ○ | ○ | ○ | ○ | ○ | ○ |
| samples/mm | 3.5 | ○ | ○ | ○ | ○ | ○ | ○ | ○ | ○ | ○ |

2. Weldability

The pieces for welding are low pressure die castings and CuZn37 brass pipes and are processed by brazing and flame heating at a temperature of 350~400° C. Weldability measuring standards relate to whether cracks and porosity appear in the welding seam and the heat affected zone. If there is no crack and no porosity, it is qualified; otherwise it is unqualified.

Fifty (50) pieces are taken from the same type of faucet body of each alloy. Test results are shown in Table 3.

TABLE 3

| Weldability of the examples and comparative alloys | | | | |
|---|---|---|---|---|
| Examples | 1 | 2 3 4 | 5 6 7 | CuZn40Pb1Al0.6 |
| After welding | Qualified | Qualified | Qualified | Qualified |
| After welding and polishing | Small part unqualified | Qualified | Qualified | Qualified |
| After welding, polishing and ammonia-fumigating | Qualified | Qualified | Qualified | Small part unqualified |

3. Cuttability

Several methods can be used for measuring the materials cuttability. The common method is fixing the cutting process parameters, measuring the cutting resistance, energy consumption or spindle torque of the machine motor and so on, comparing with free-cutting lead brass such as C36000 and finally obtaining the relative cutting rate. Actually, good or poor materials' cuttability is very closely related to the cutting process parameters. In actual production, the cuttability of the mand size of the chips, smooth degree of chip discharging and wear speed of the tools. The cutting process parameters can be adjusted on the base of different materials or different states material is "good" or "poor," is always judged by the shape of the same material for getting successful cutting operation.

The influence of the cutting process parameters on chip shape is shown in Table 4. This shows that feeding quantity has great influence on chip shape and size, while linear speed has little influence on chip shape and size. If feeding quantity is 0.2 mm/rev. and 0.3 mm/rev., the chip shape of example alloy 1 is a thin sheet or thin tile. It indicates cuttability is good, but not better than lead brass which contains 1 wt % Pb. Cutting depth is 4 mm.

TABLE 4

Influence of cutting process parameters on chip shape

Figure 1B:
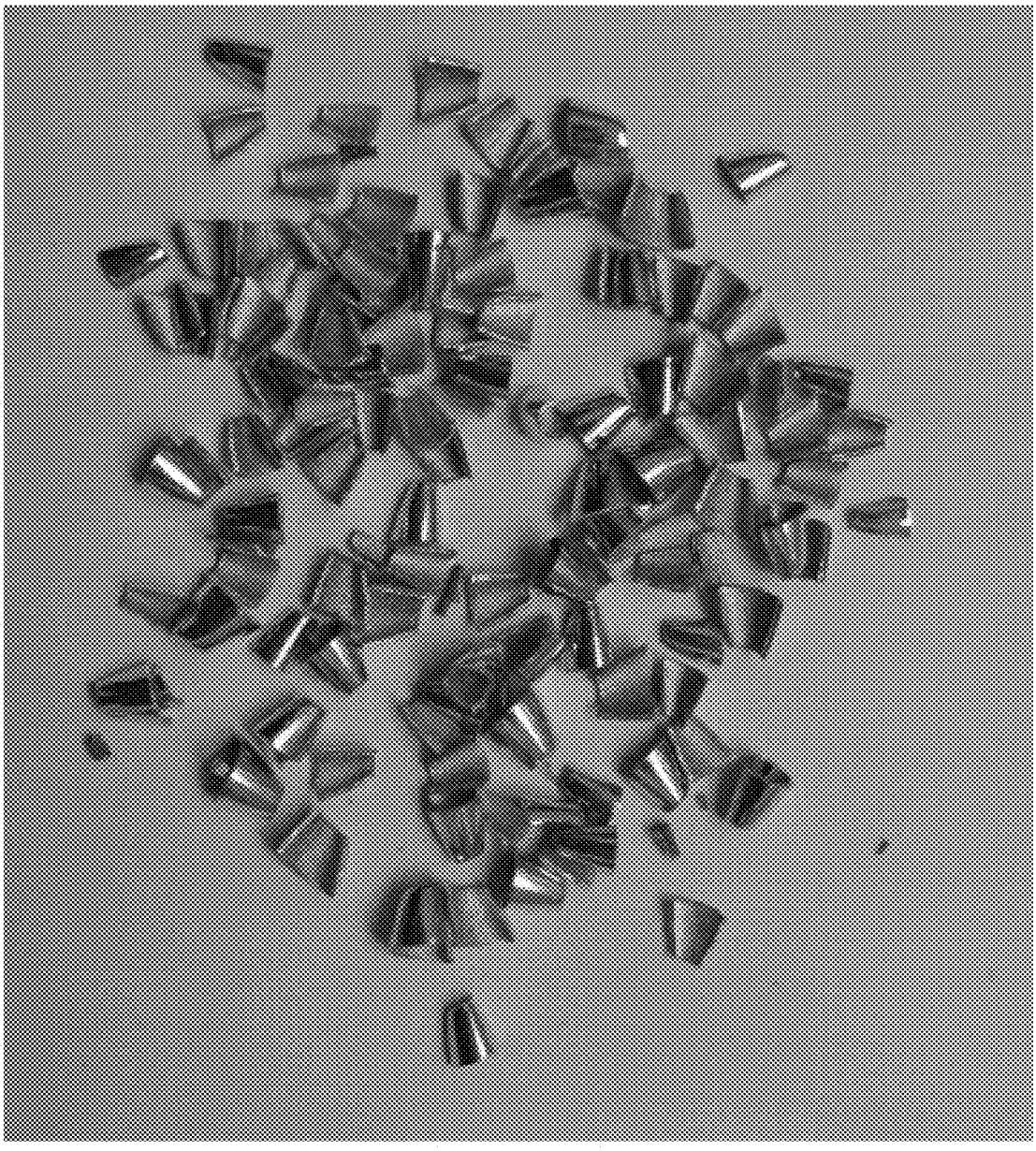
Figure 1C:
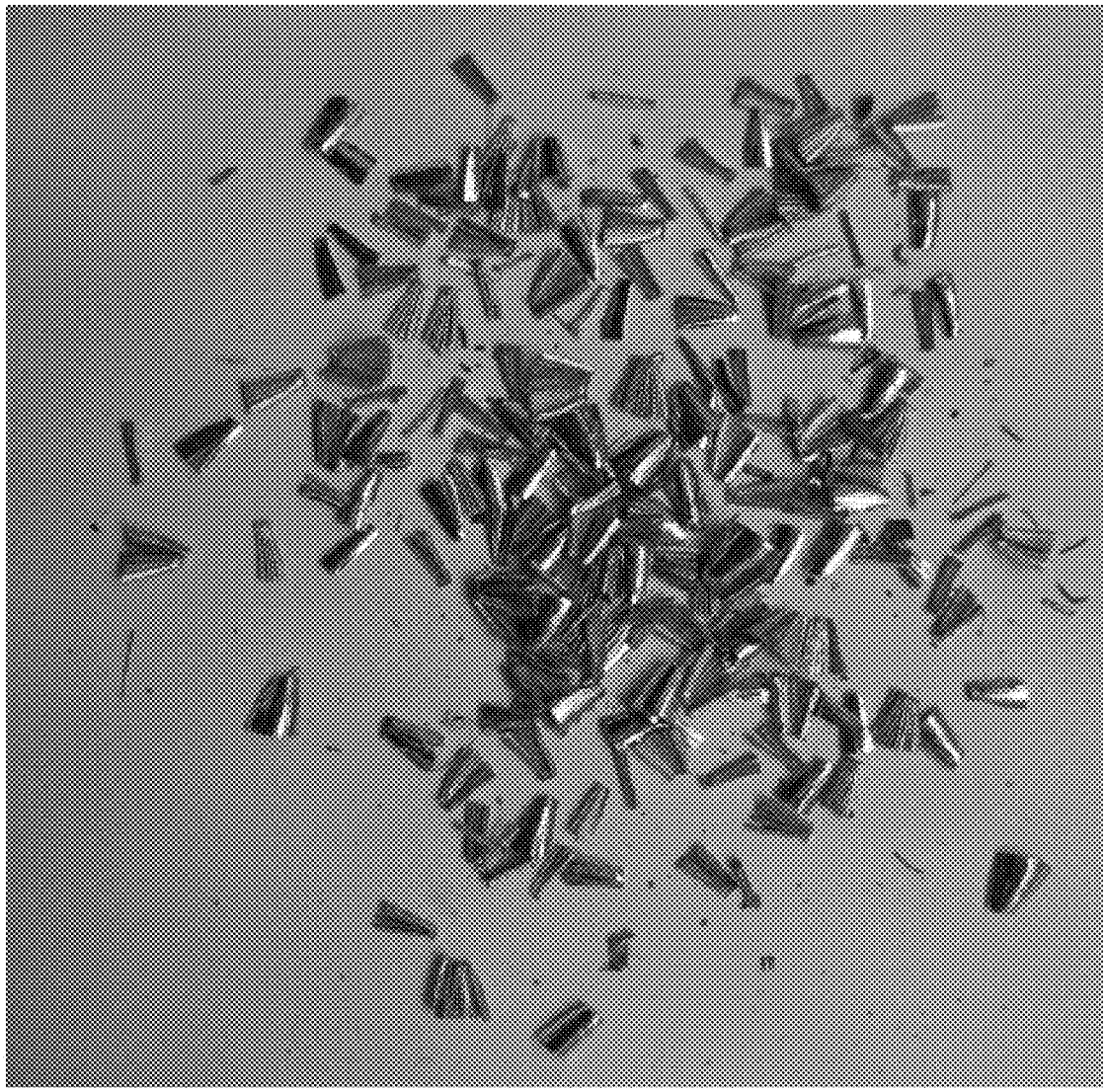
Figure 1D:
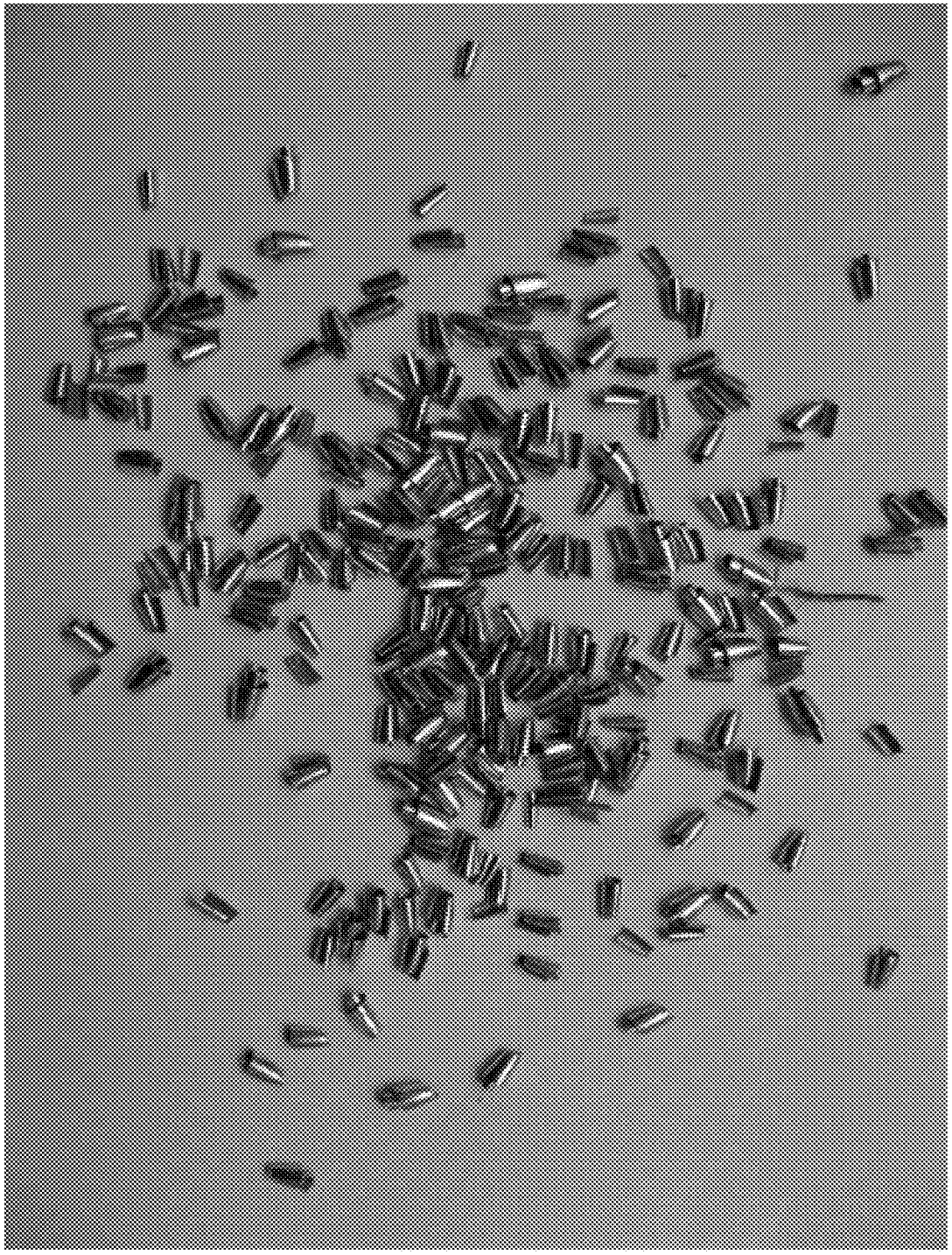
FIGS. 1D, 1E and 1F show the chip shape of alloy CuZn40Pb1A10.6 obtained at a cutting speed of 40 m/minute, at feeding quantities of 0.1, 0.2, and 0.3 mm/revolution, respectively.
Figure 1E:
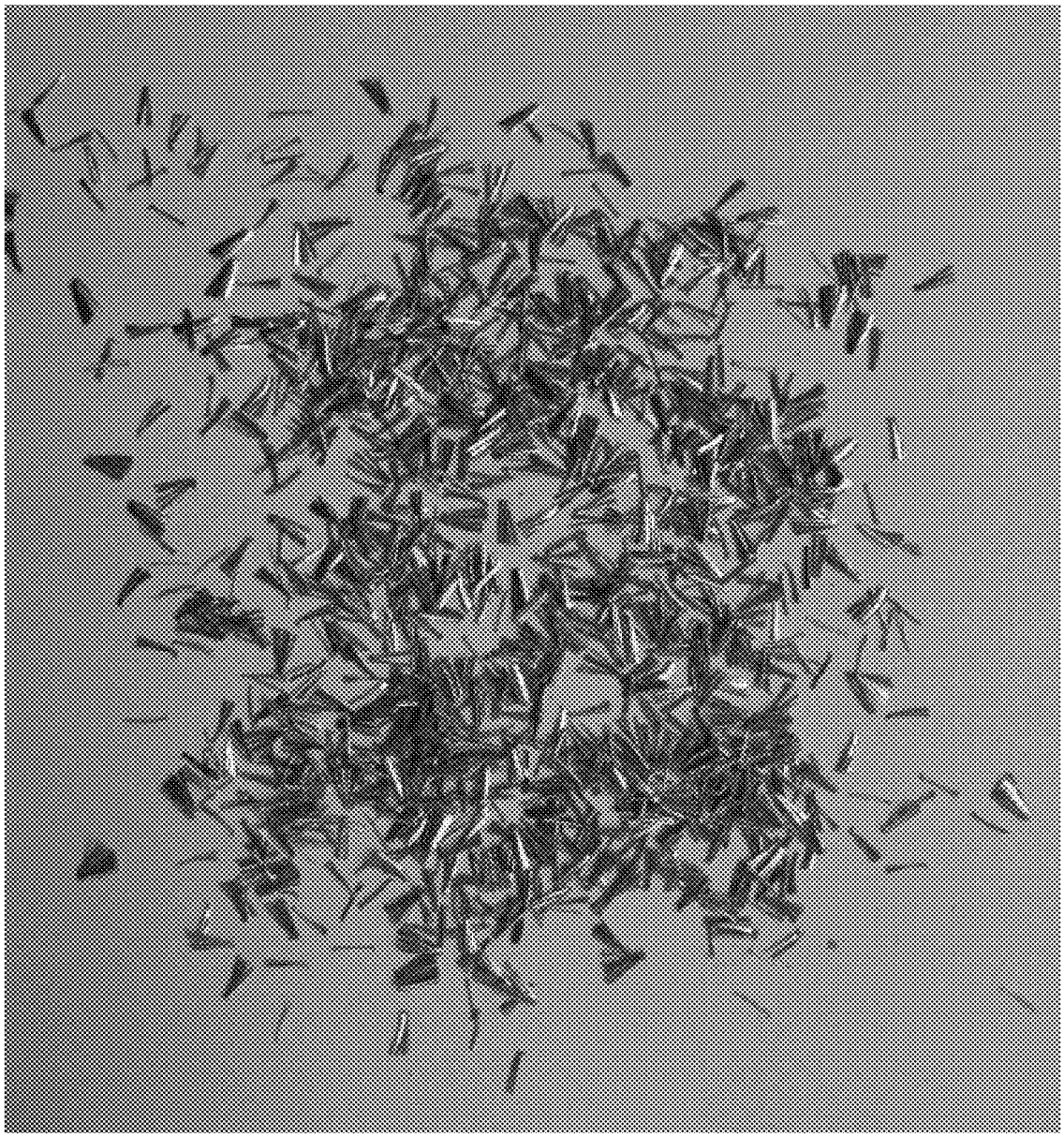
Figure 1F:
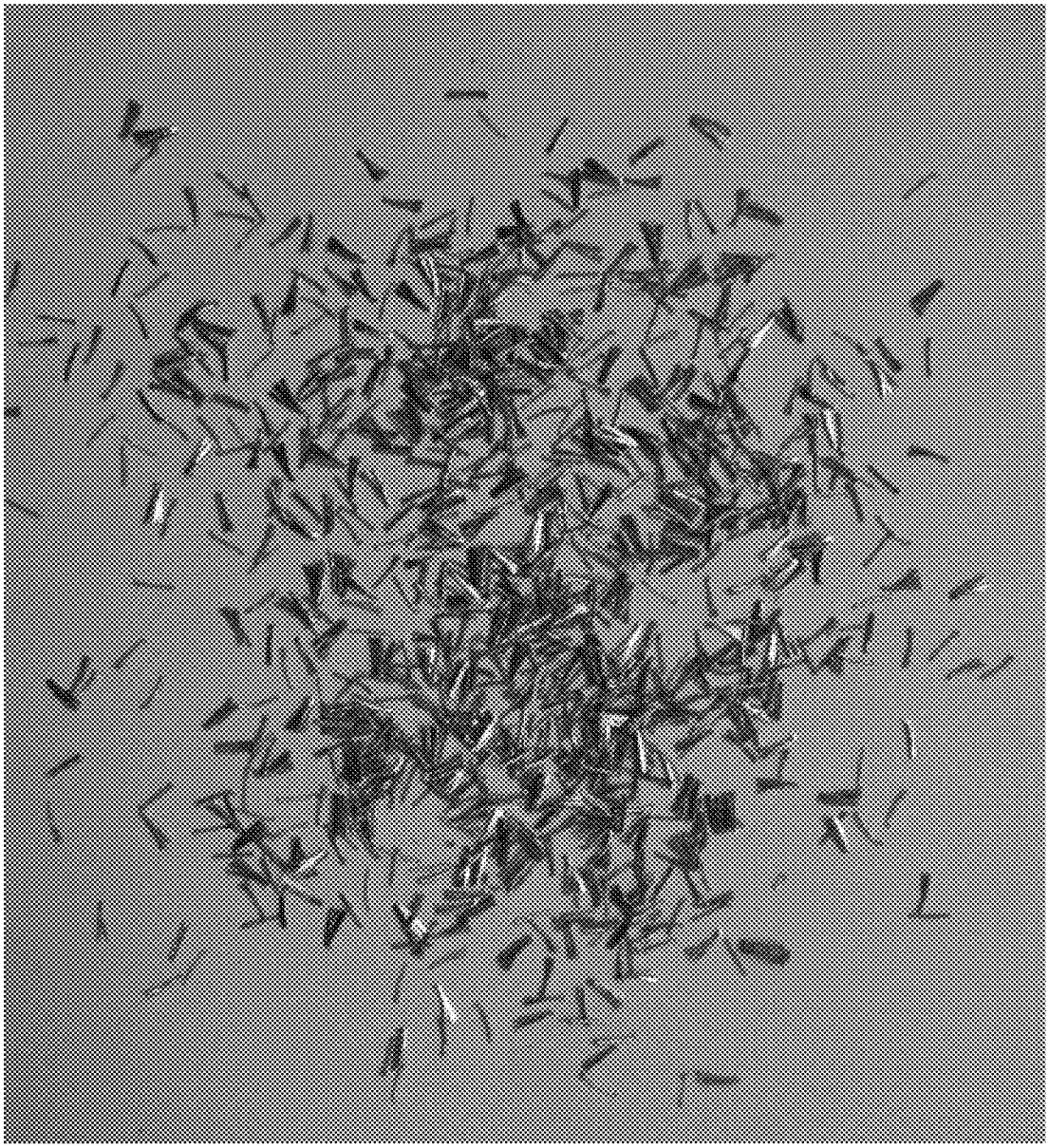
Figure 2A:
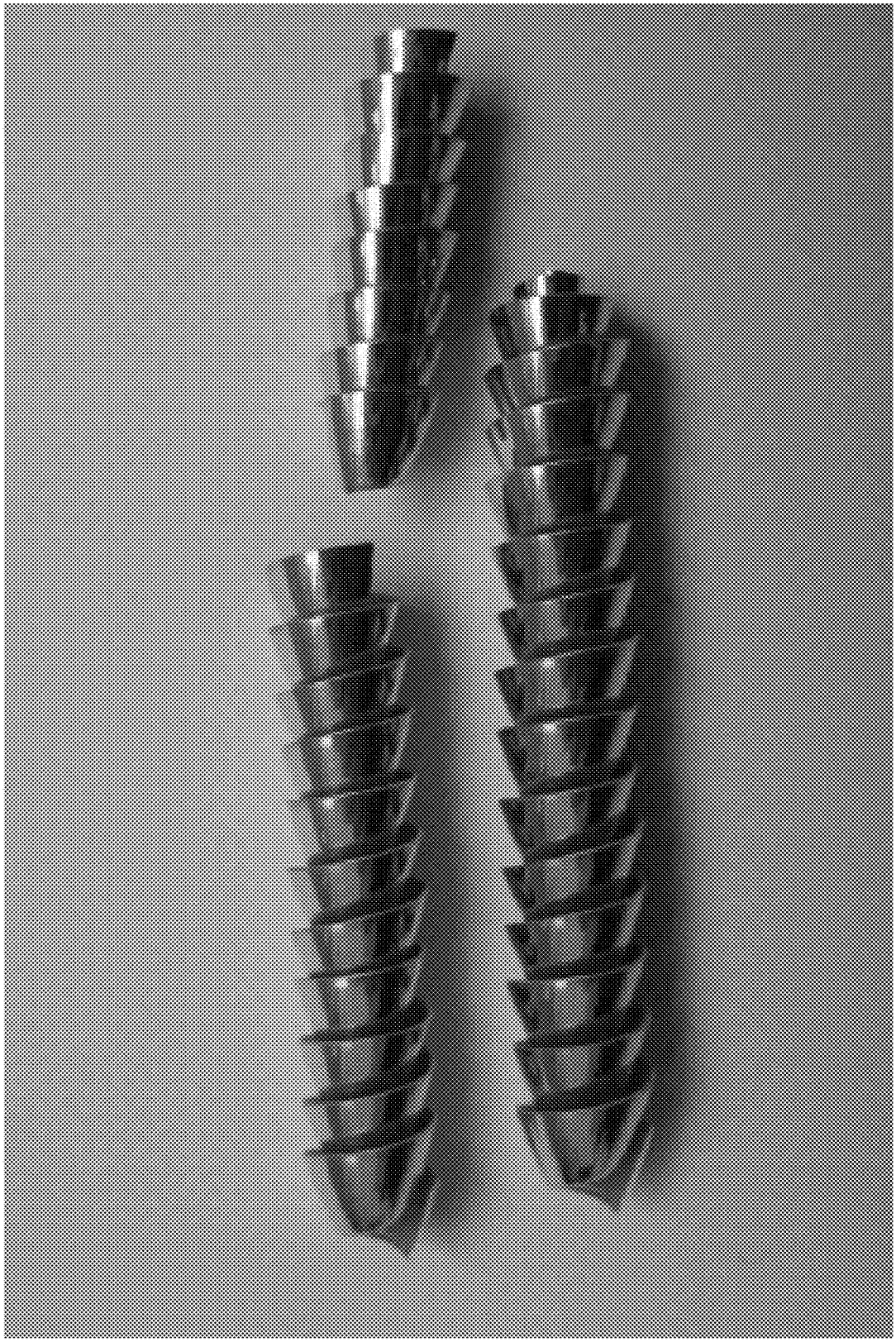
FIGS. 2A, 2B and 2C show the chip shape of example alloy 1 obtained at a cutting speed of 60 m/minute, at feeding quantities of 0.1, 0.2, and 0.3 mm/revolution, respectively.
Figure 2B:
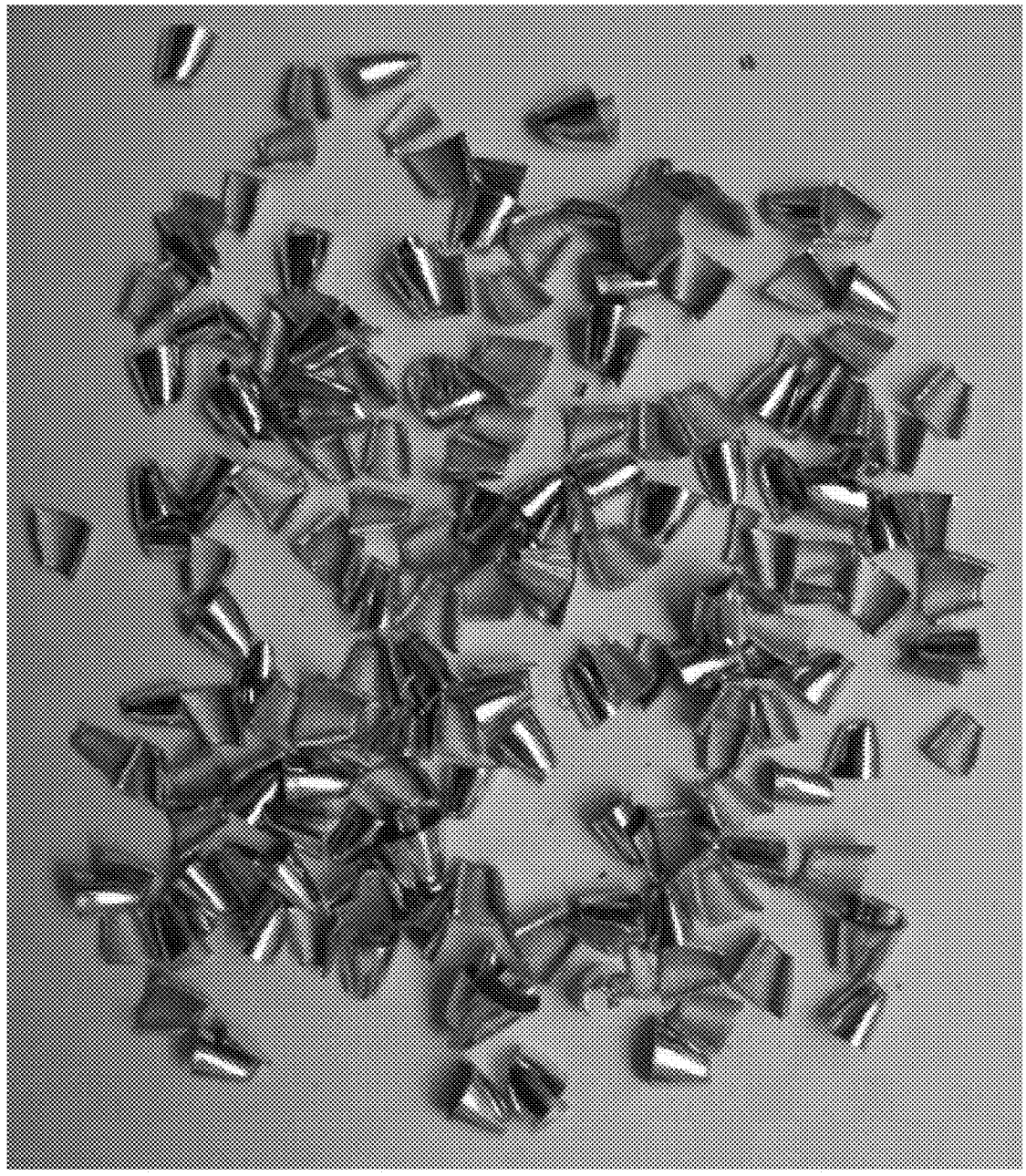
Figure 2C:
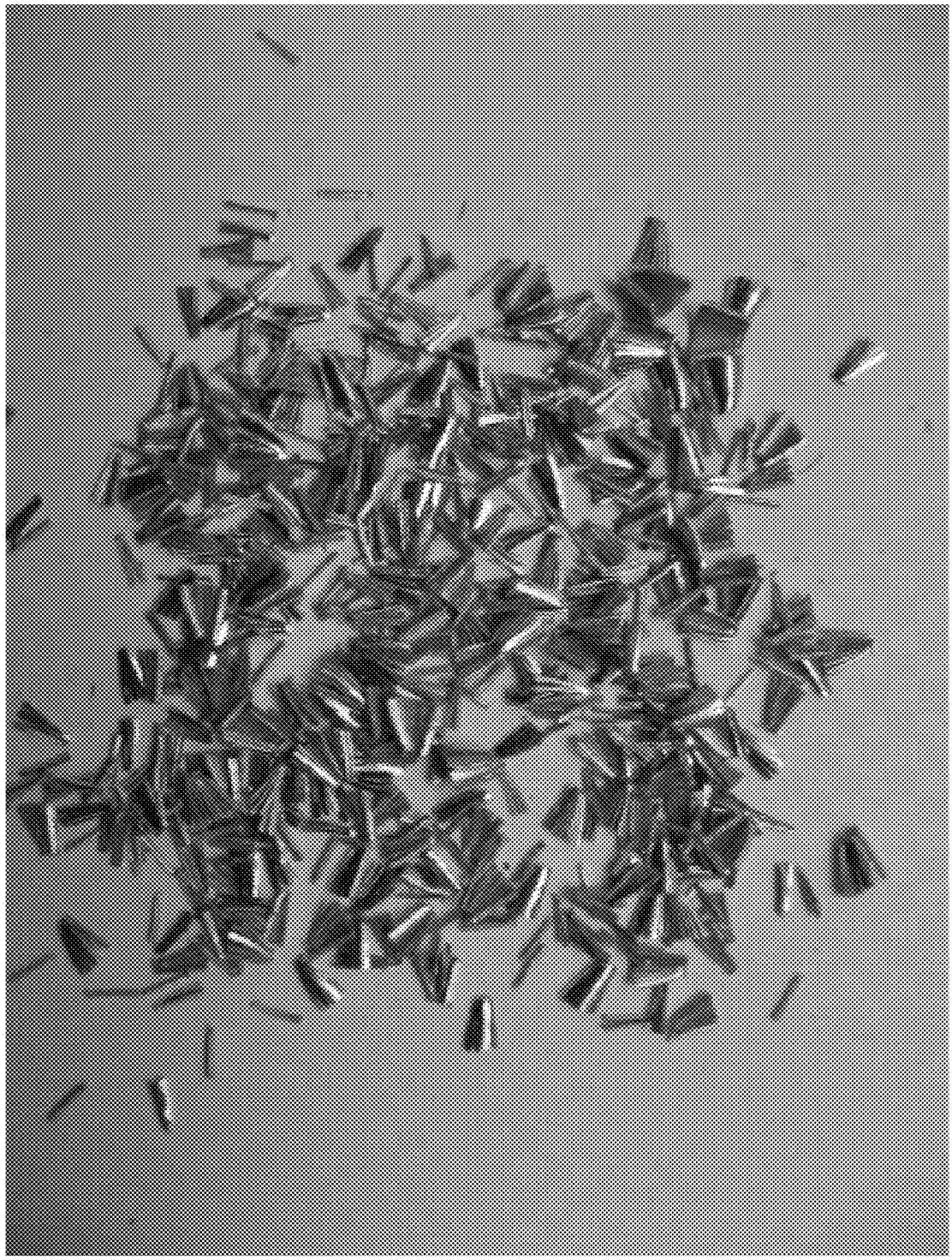
Figure 2D:
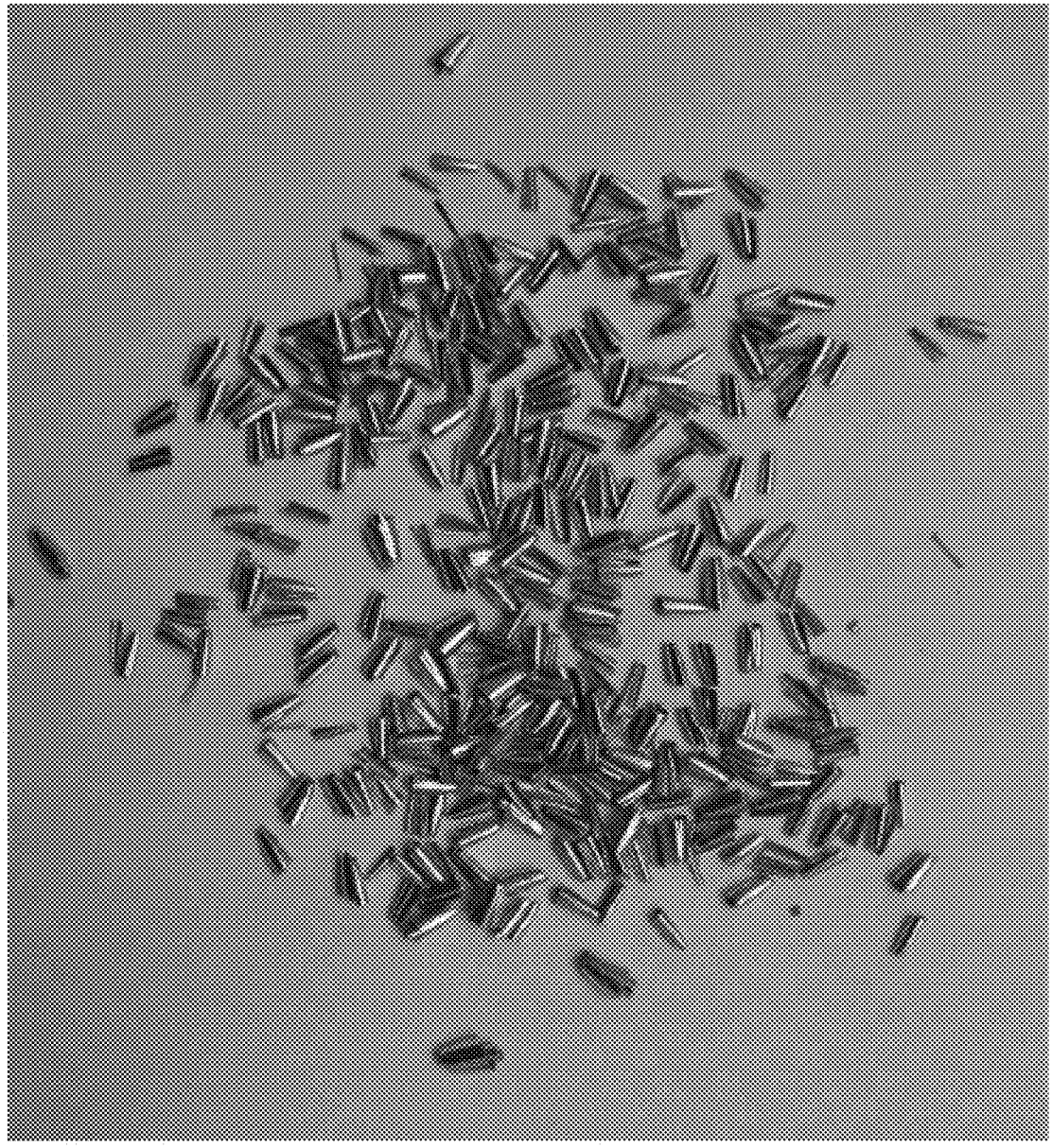
FIGS. 2D, 2E and 2F show the chip shape of alloy CuZn40Pb1A10.6 obtained at a cutting speed of 60 m/minute, at feeding quantities of 0.1, 0.2, and 0.3 mm/revolution, respectively.
Figure 2E:
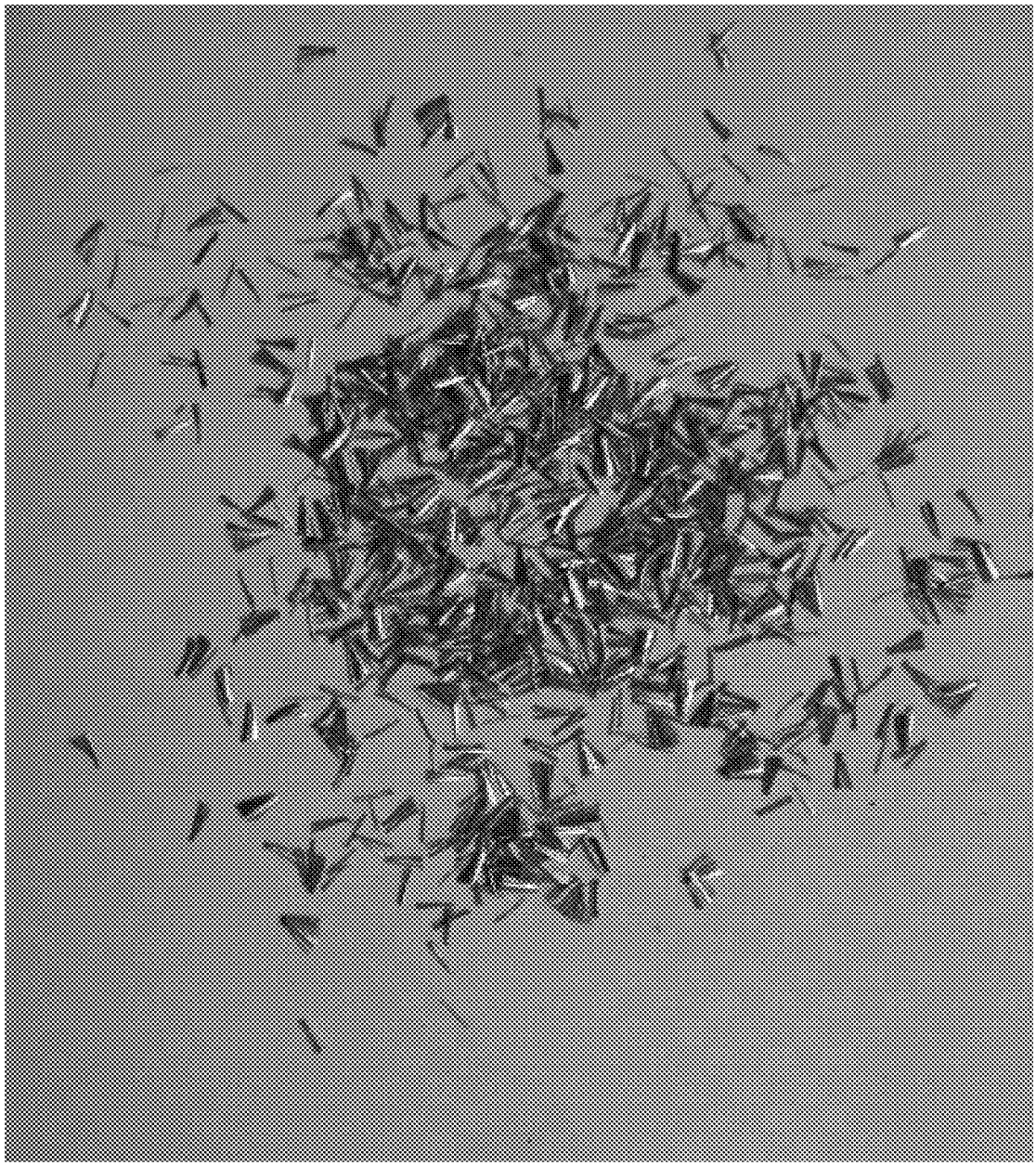
Figure 2F:
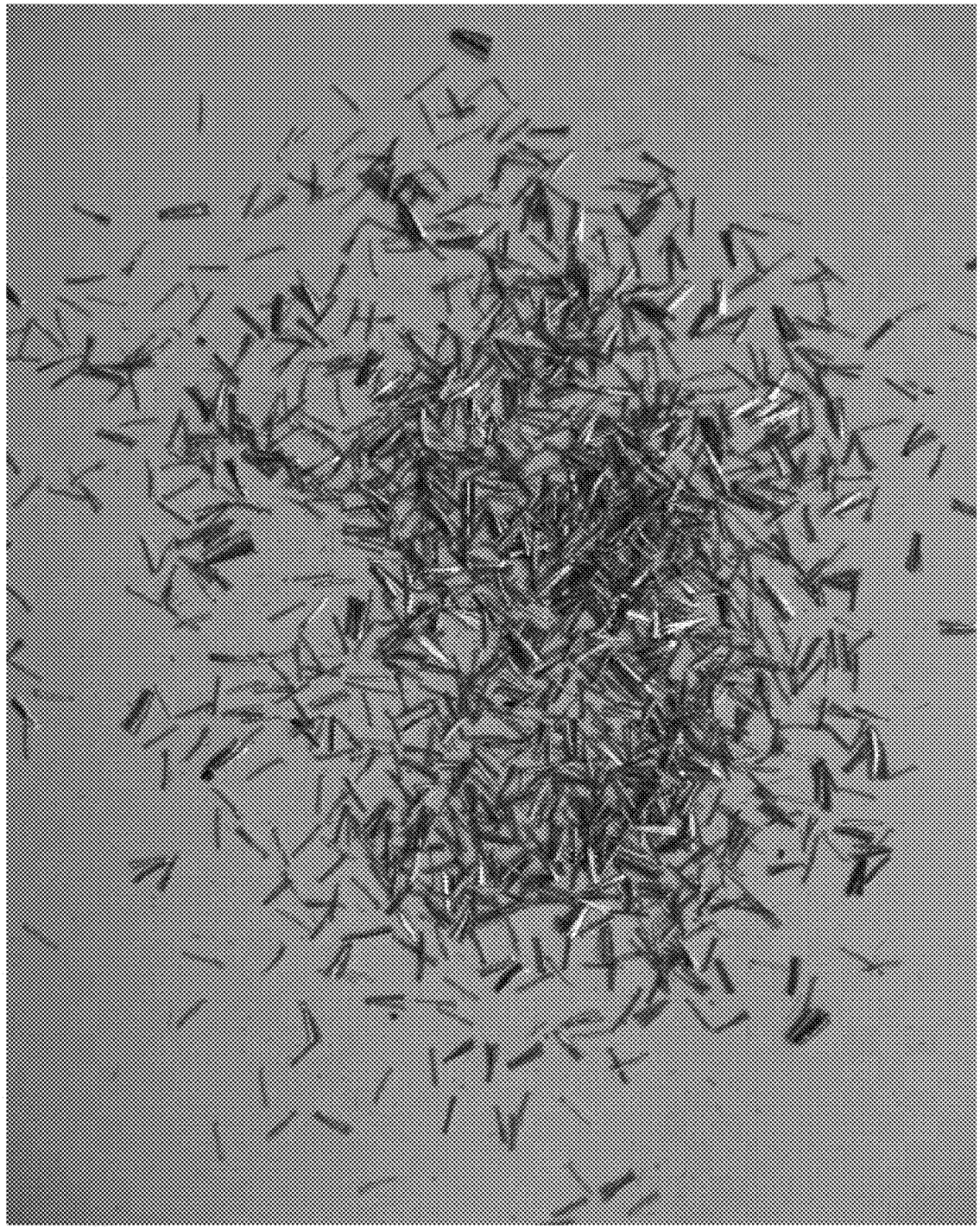
Figure 3A:
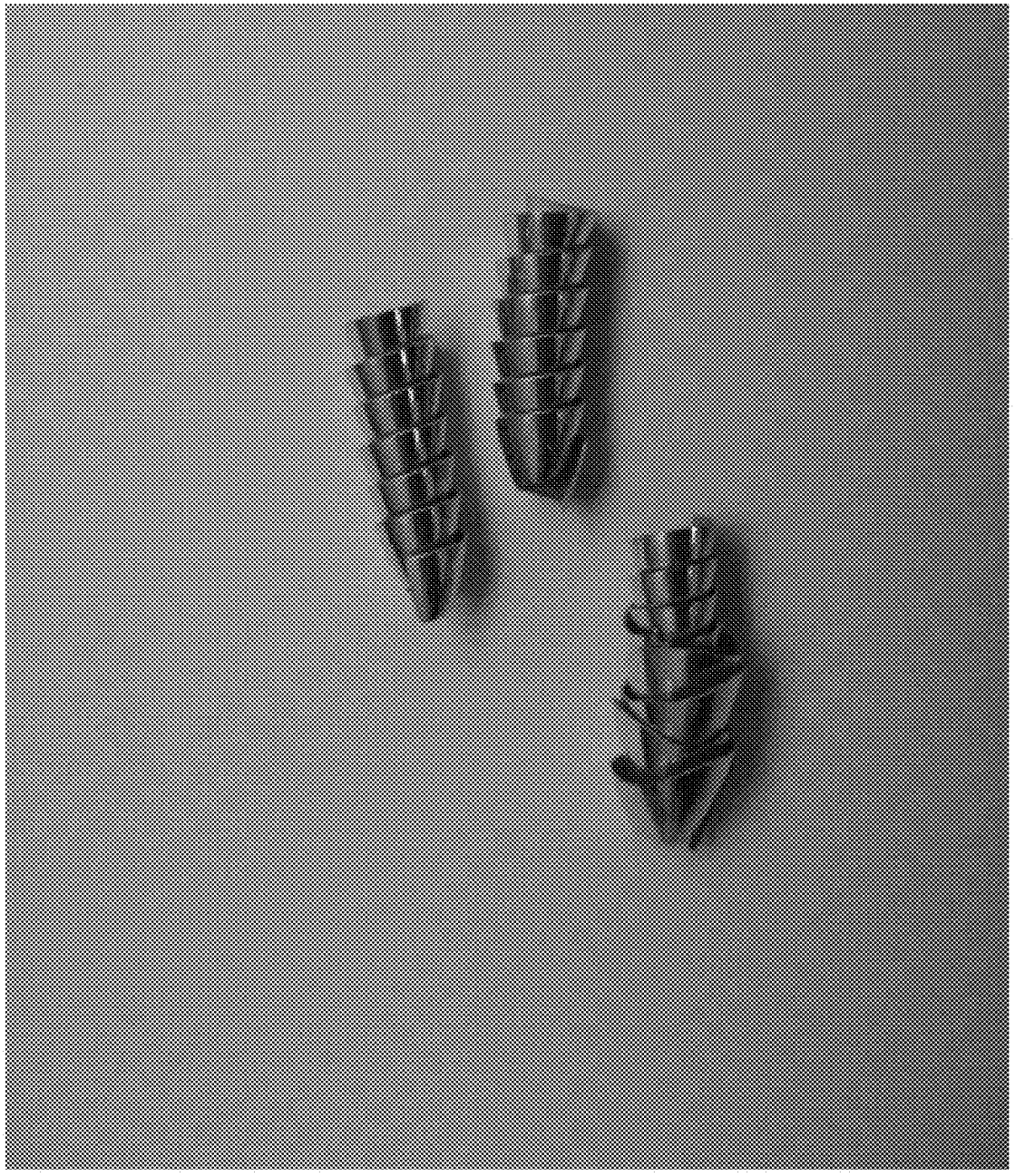
FIGS. 3A, 3B and 3C show the chip shape of example alloy 1 obtained at a cutting speed of 80 m/minute, at feeding quantities of 0.1, 0.2, and 0.3 mm/revolution, respectively.
Figure 3B:
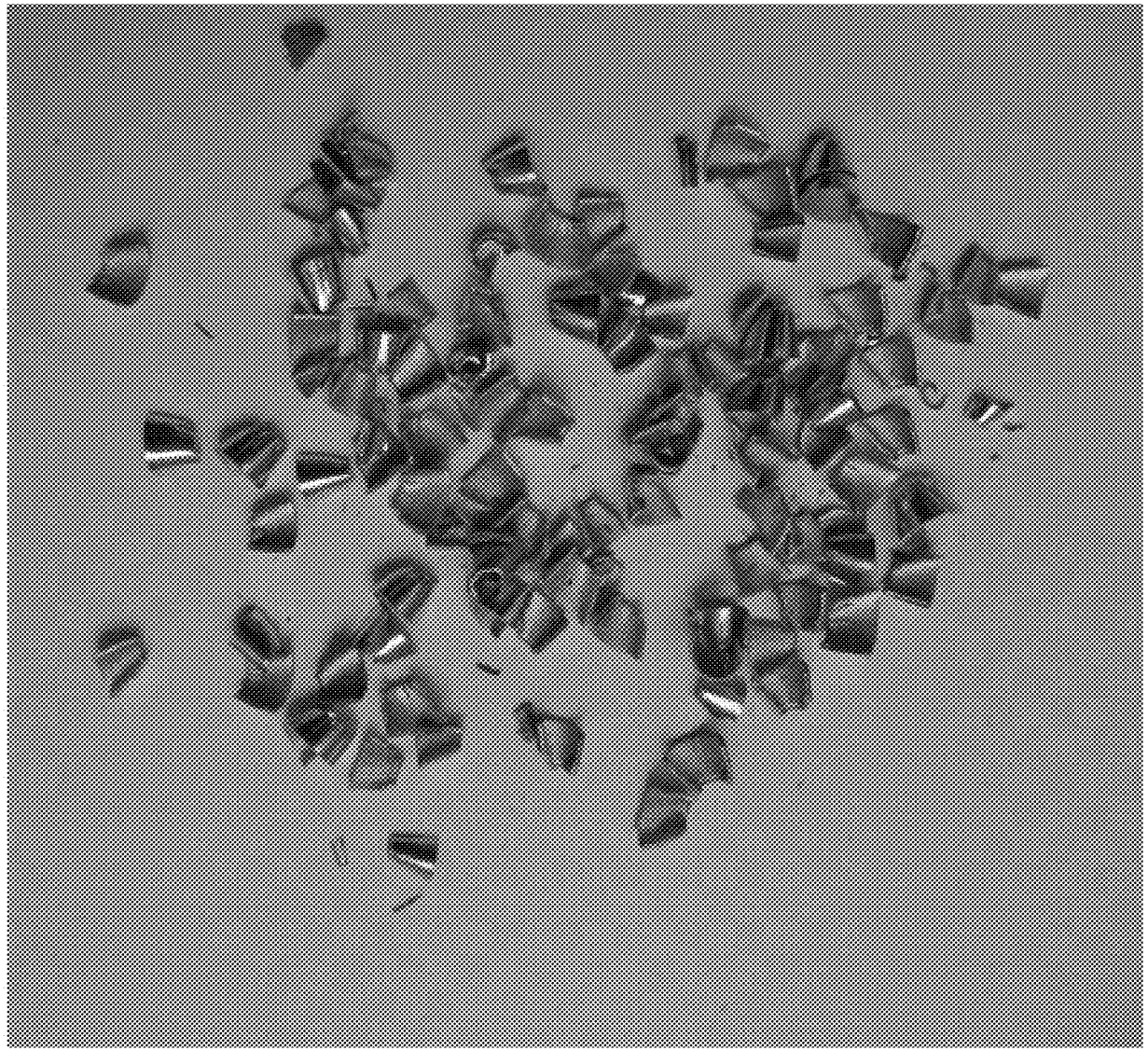
Figure 3C:
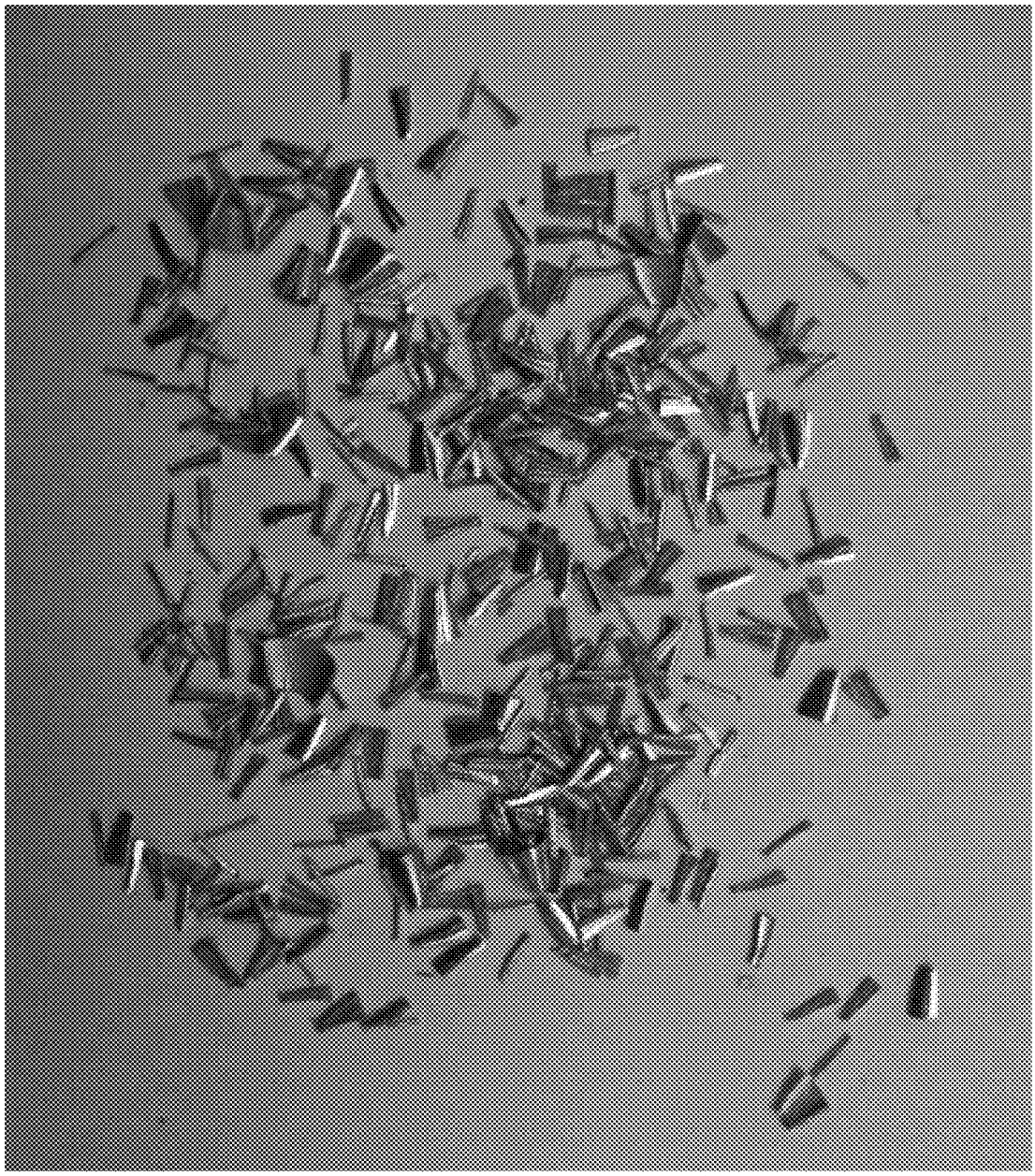
Figure 3D:
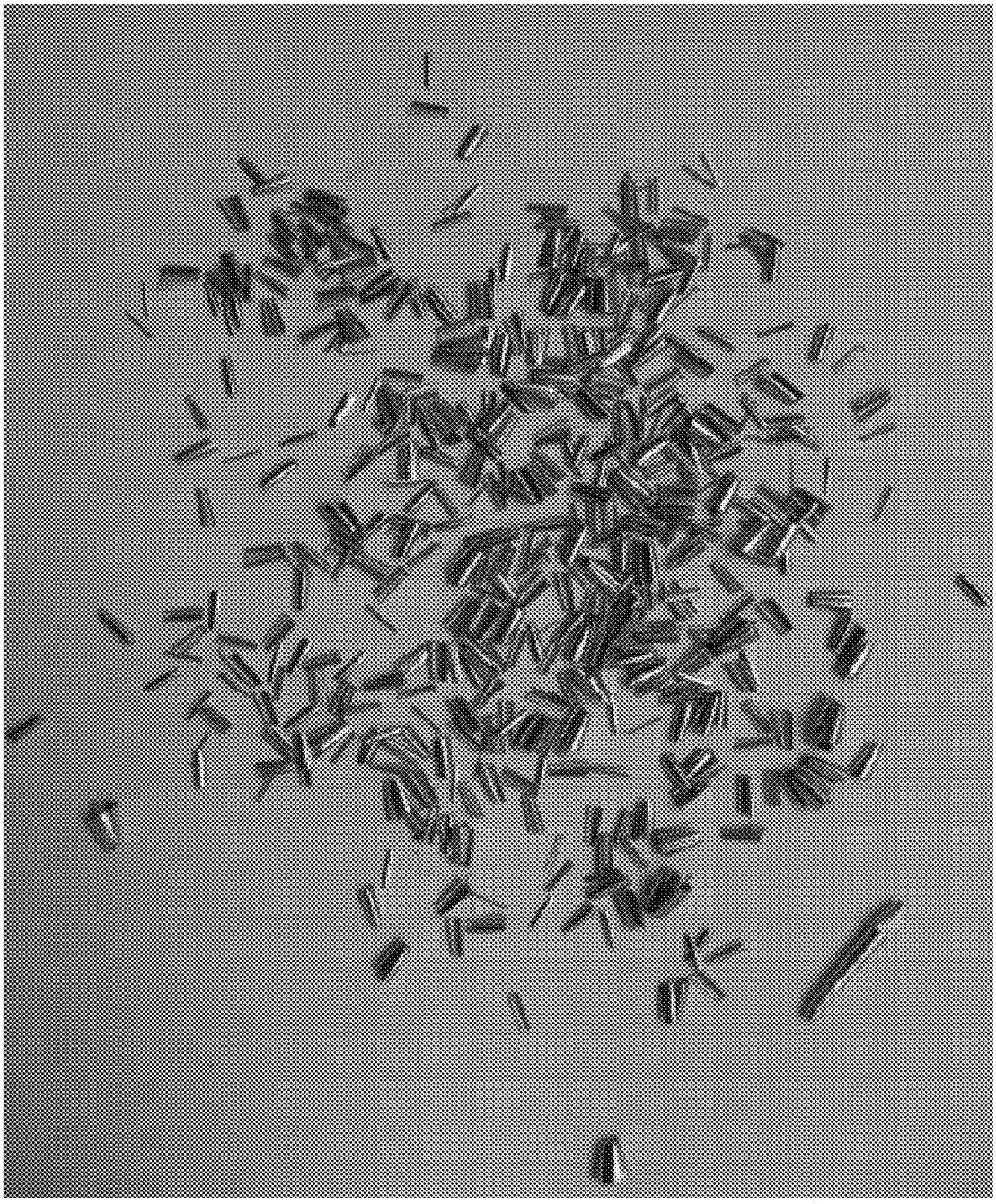
FIGS. 3D, 3E and 3F show the chip shape of alloy CuZn40Pb1A10.6 obtained at a cutting speed of 80 m/minute, at feeding quantities of 0.1, 0.2, and 0.3 mm/revolution, respectively.
Figure 3E:
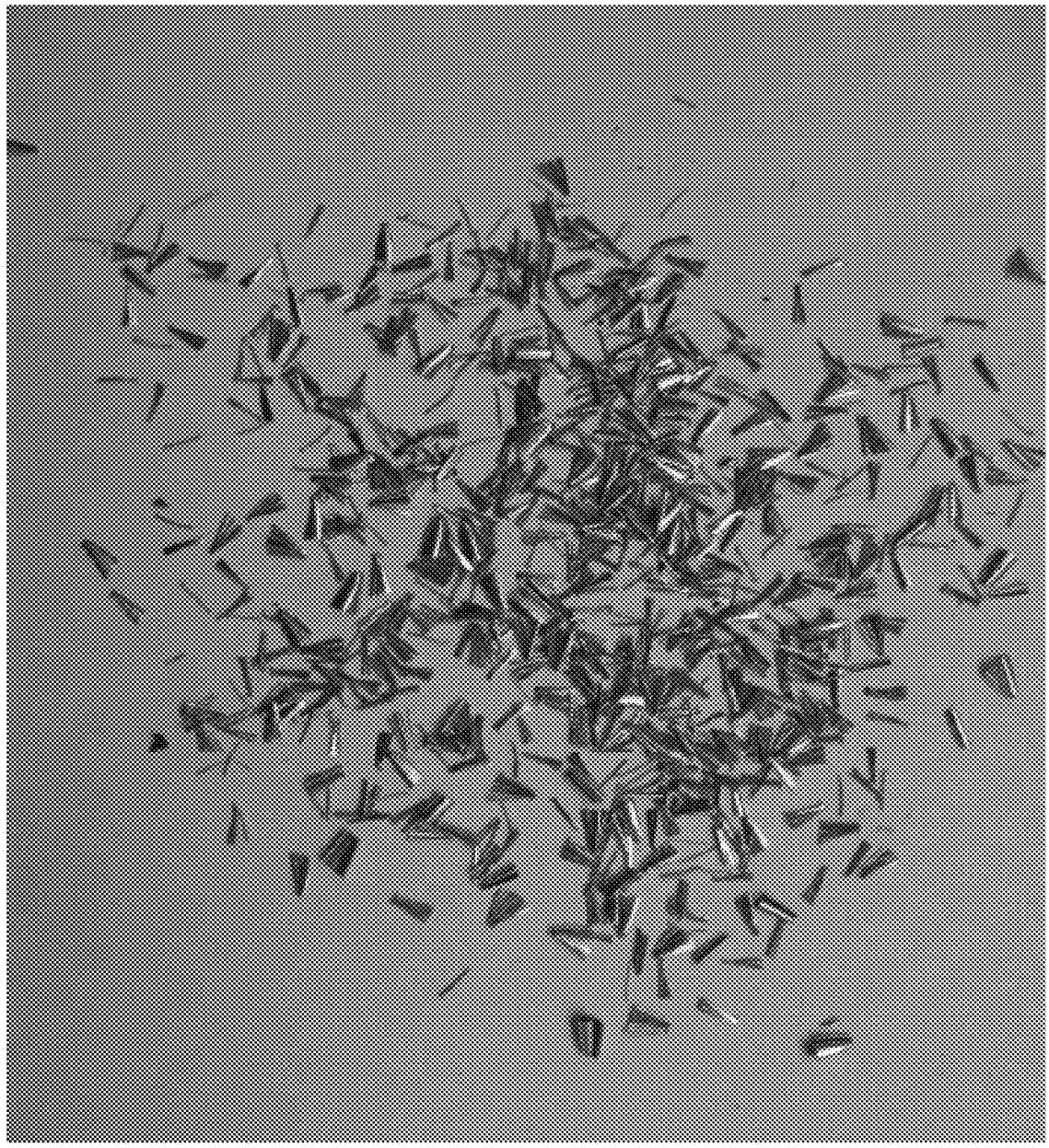
Figure 3F:
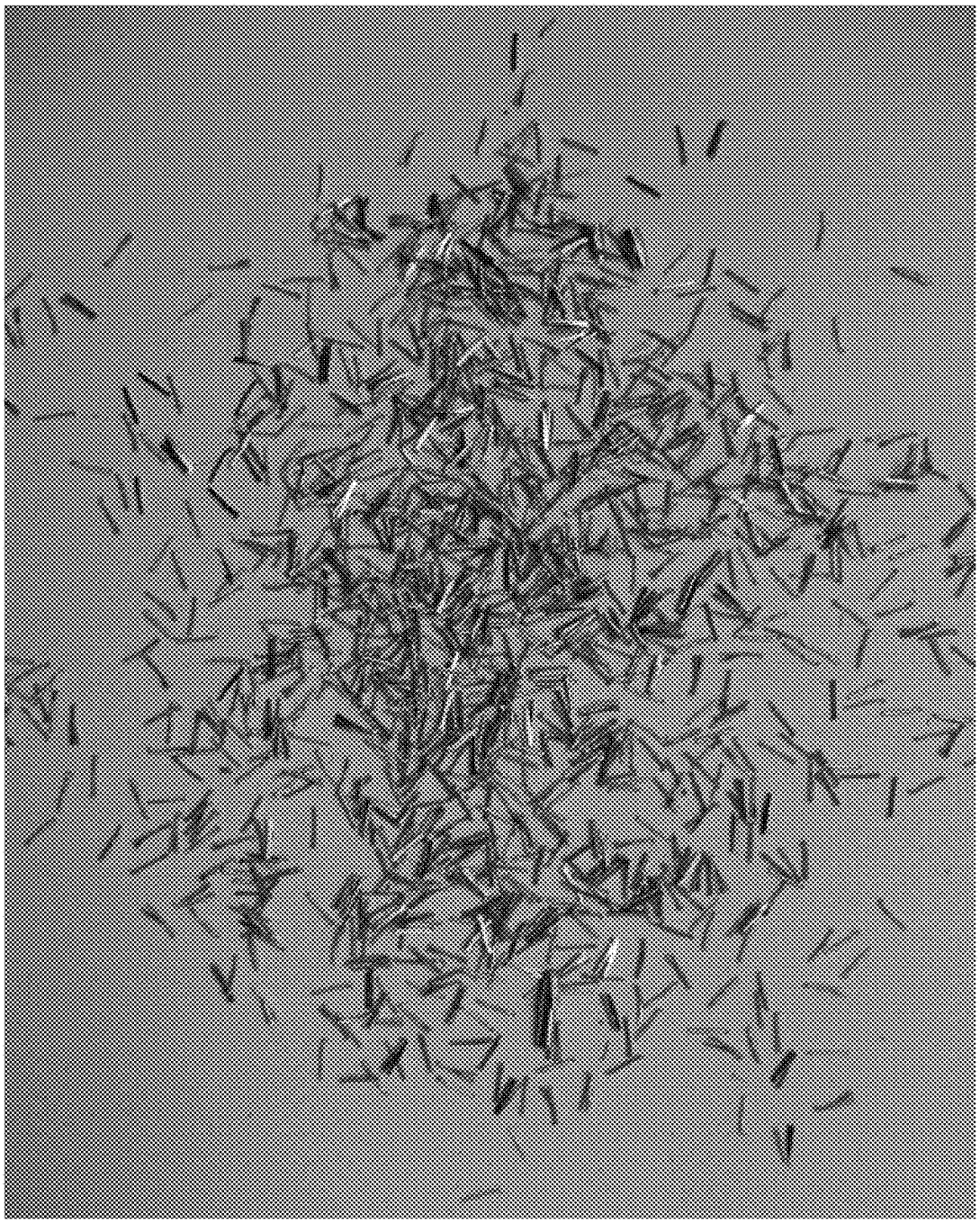
Figure 4A:
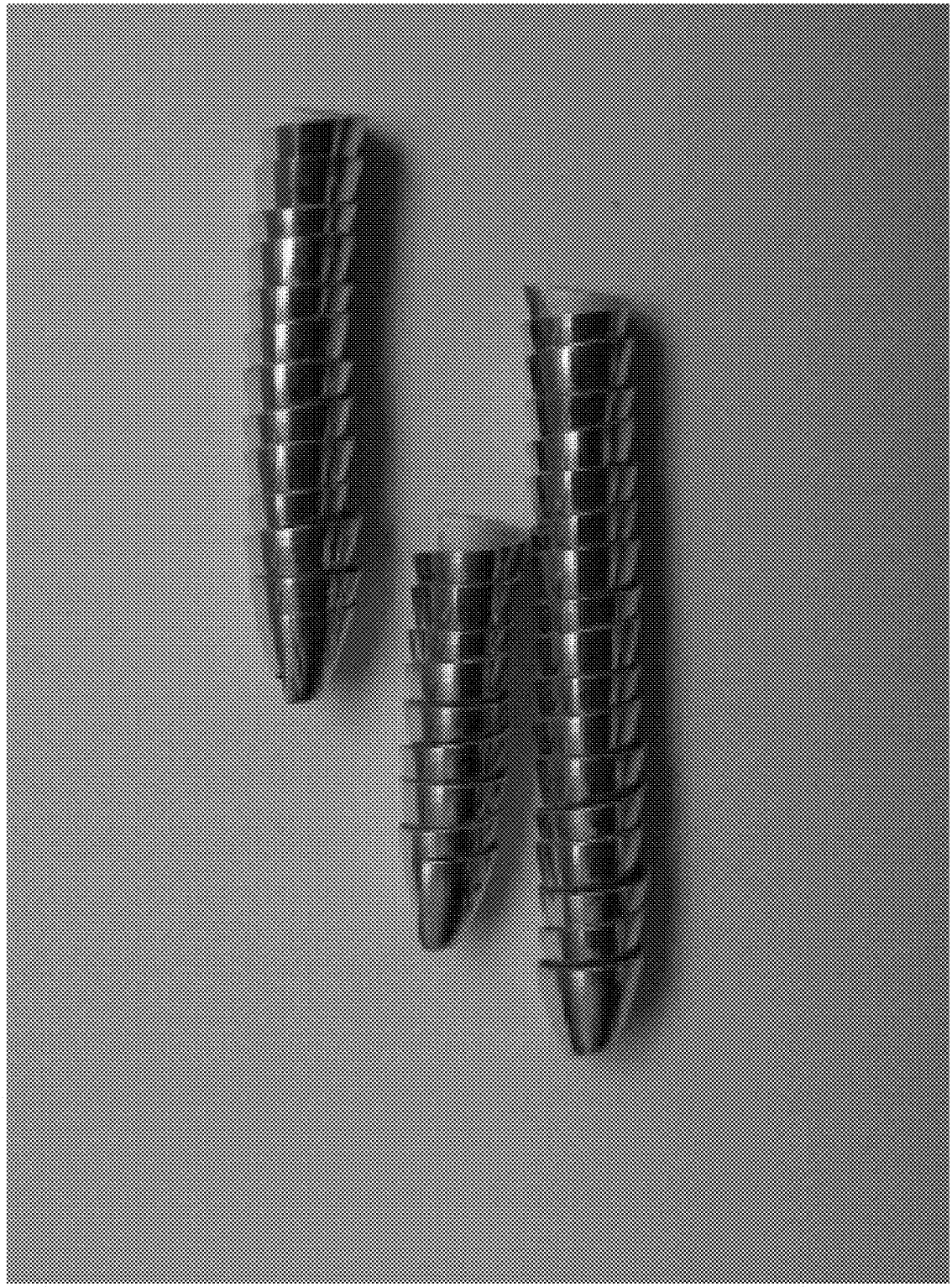
FIGS. 4A, 4B and 4C show the chip shape of example alloy 1 obtained at a cutting speed of 100 m/minute, at feeding quantities of 0.1, 0.2, and 0.3 mm/revolution, respectively.
Figure 4B:
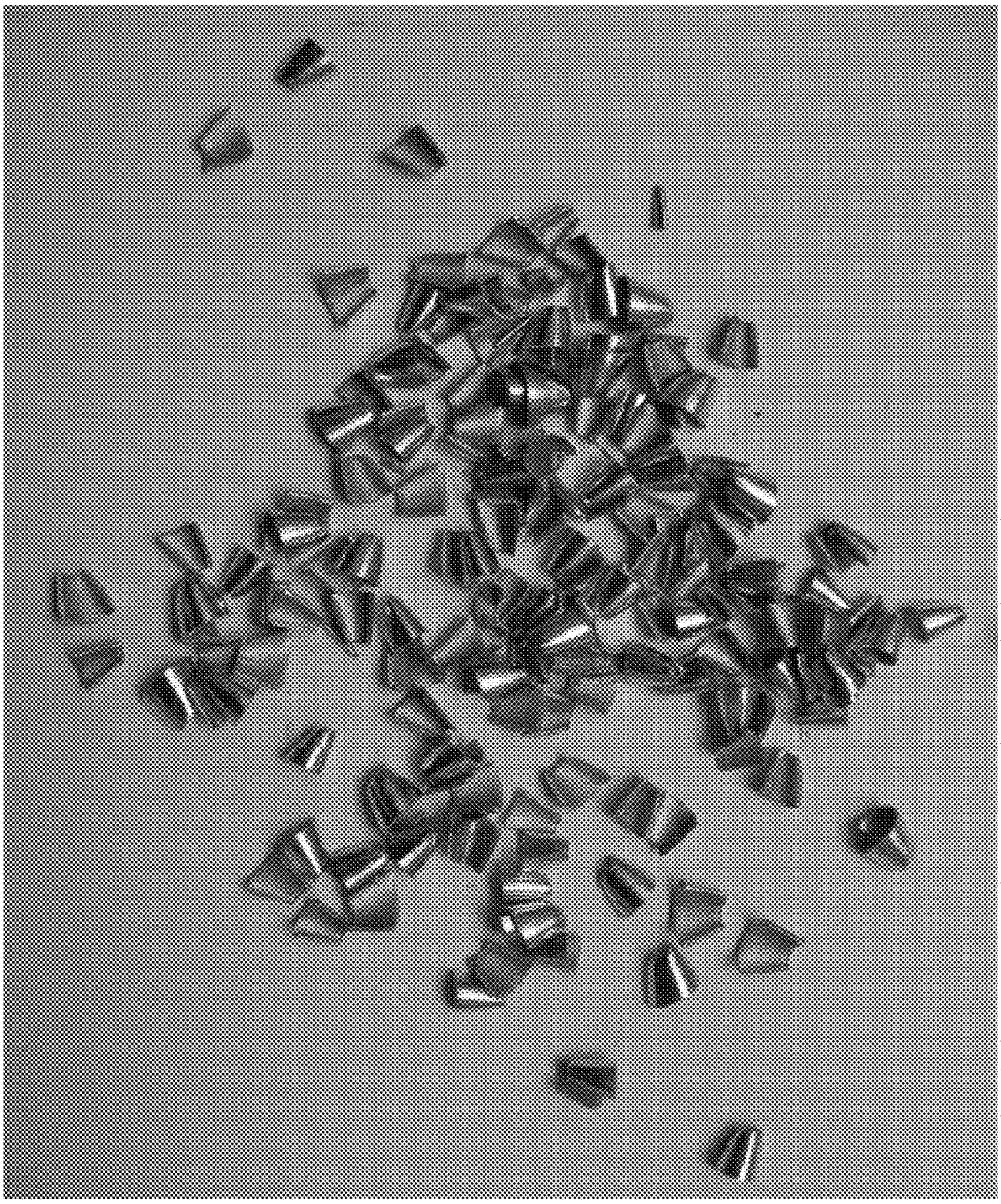
Figure 4C:
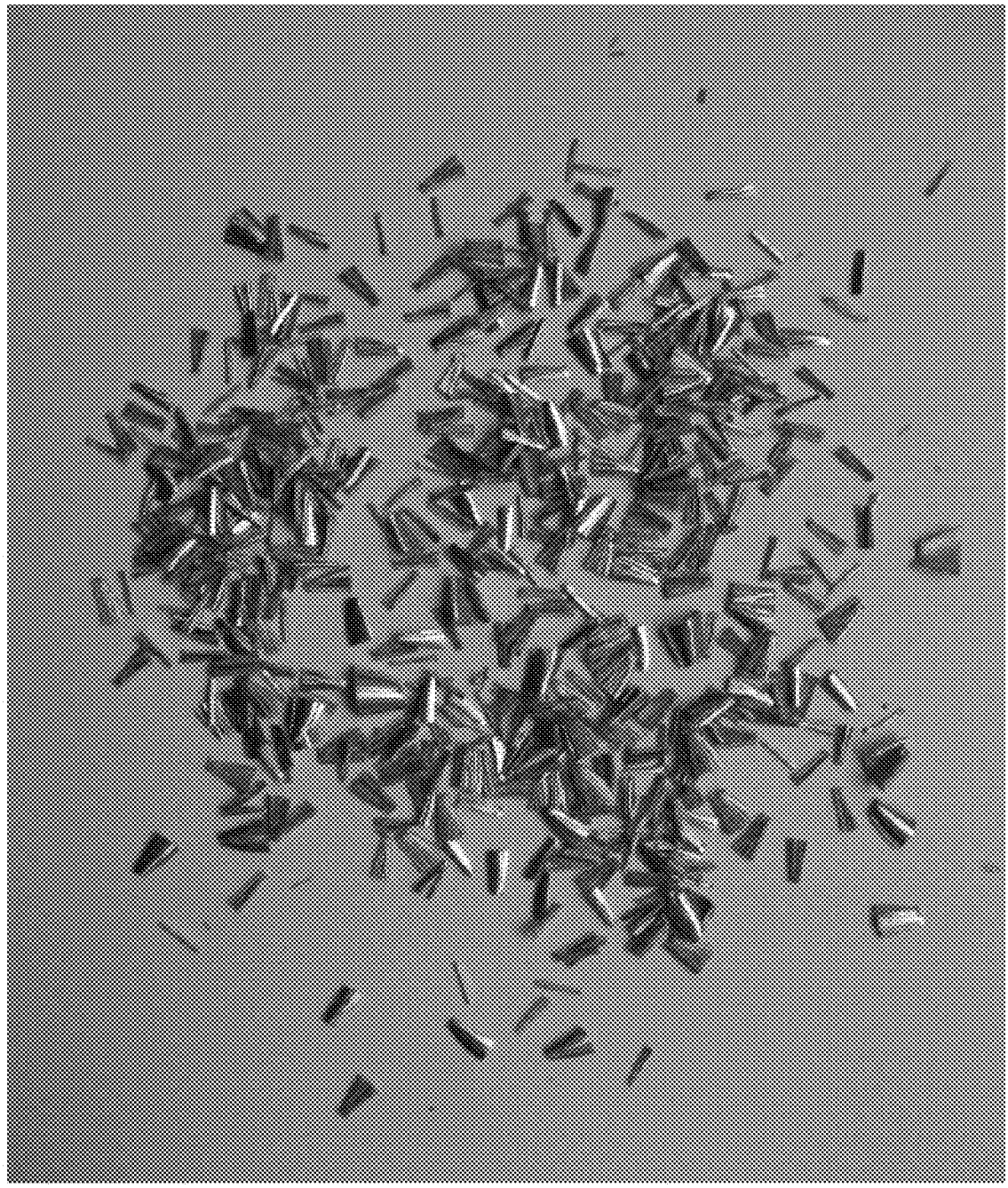
Figure 4D:
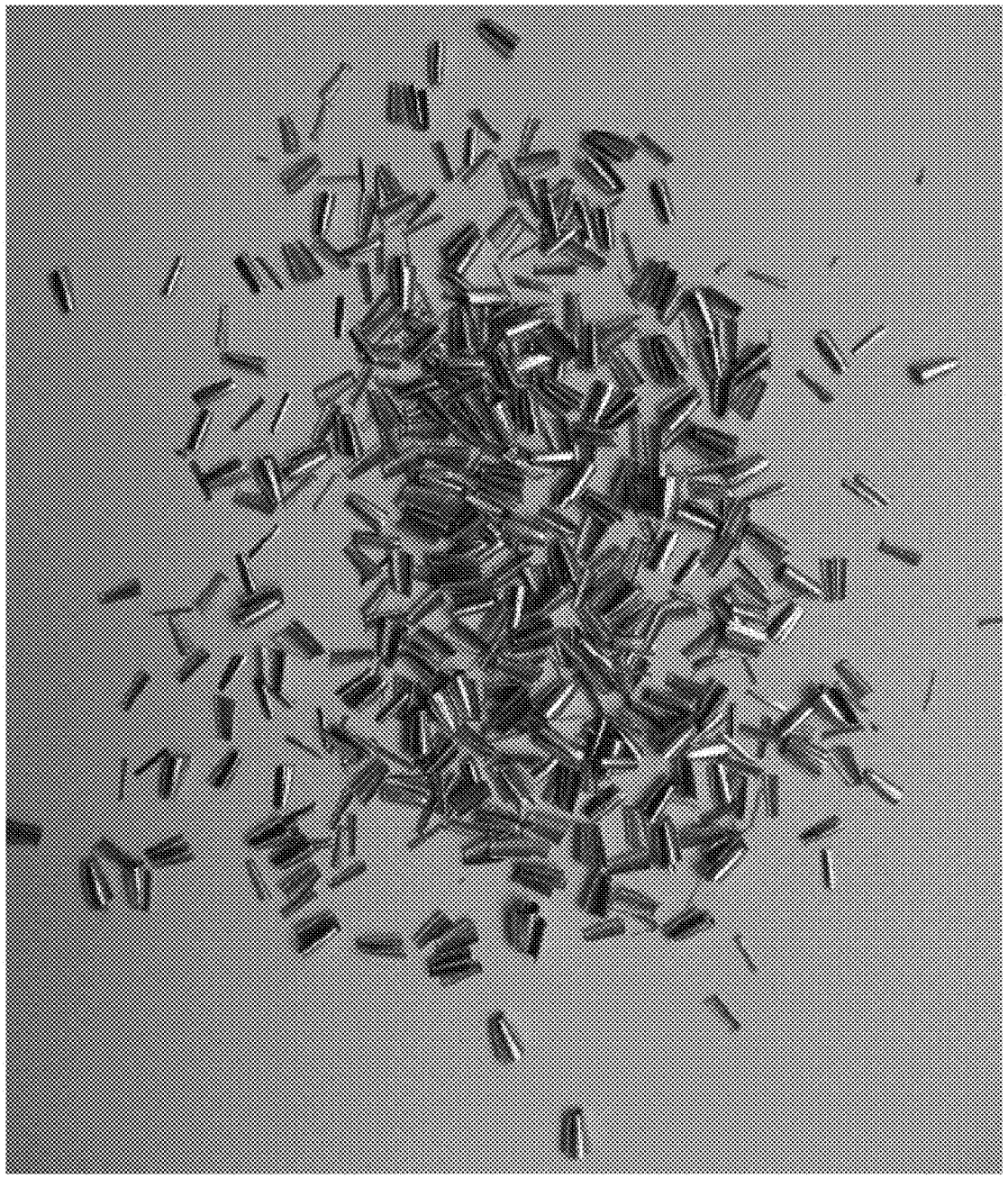
FIGS. 4D, 4E and 4F show the chip shape of alloy CuZn40Pb1A10.6 obtained at a cutting speed of 100 m/minute, at feeding quantities of 0.1, 0.2, and 0.3 mm/revolution, respectively.
Figure 4E:
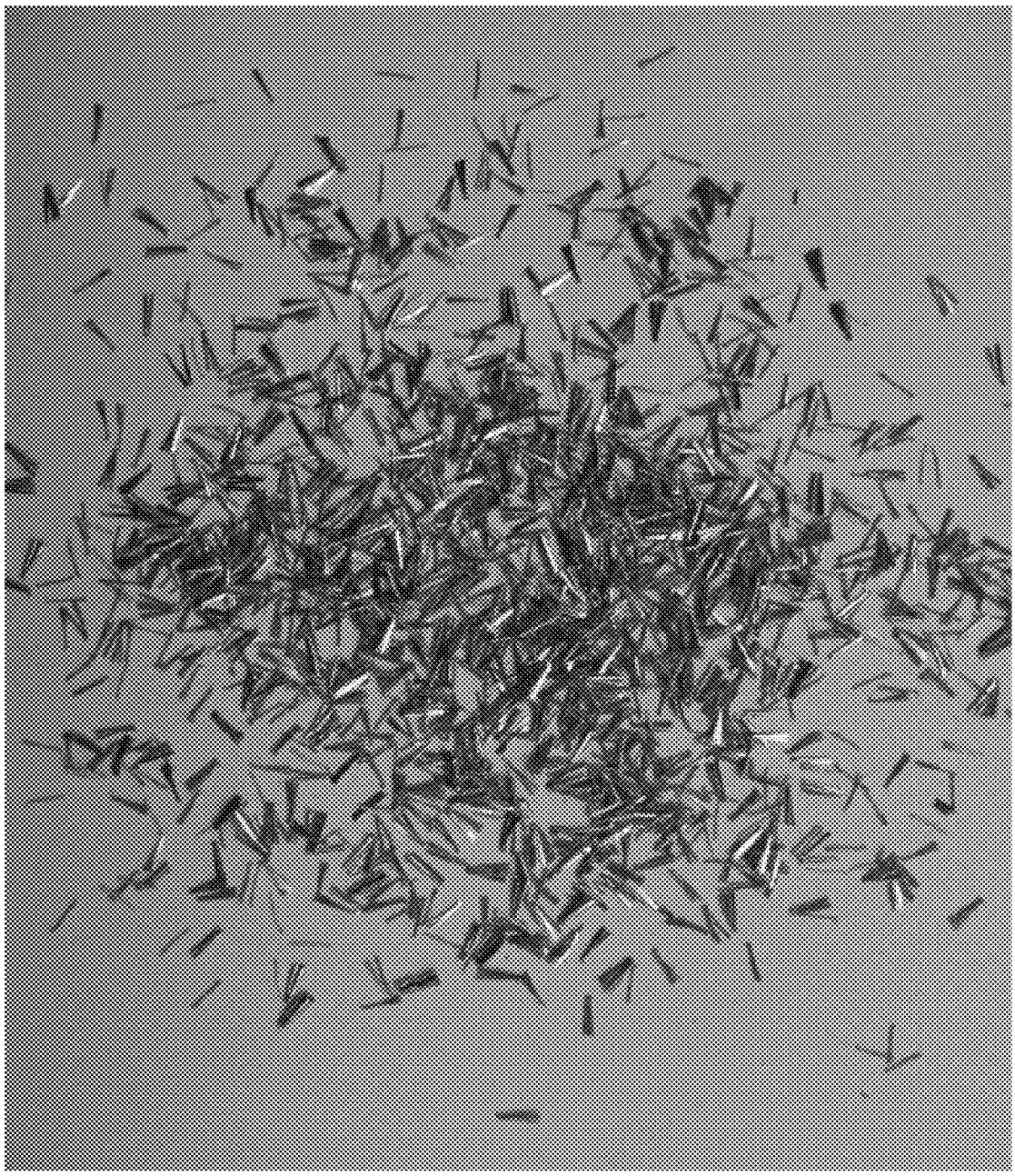
Figure 4F:
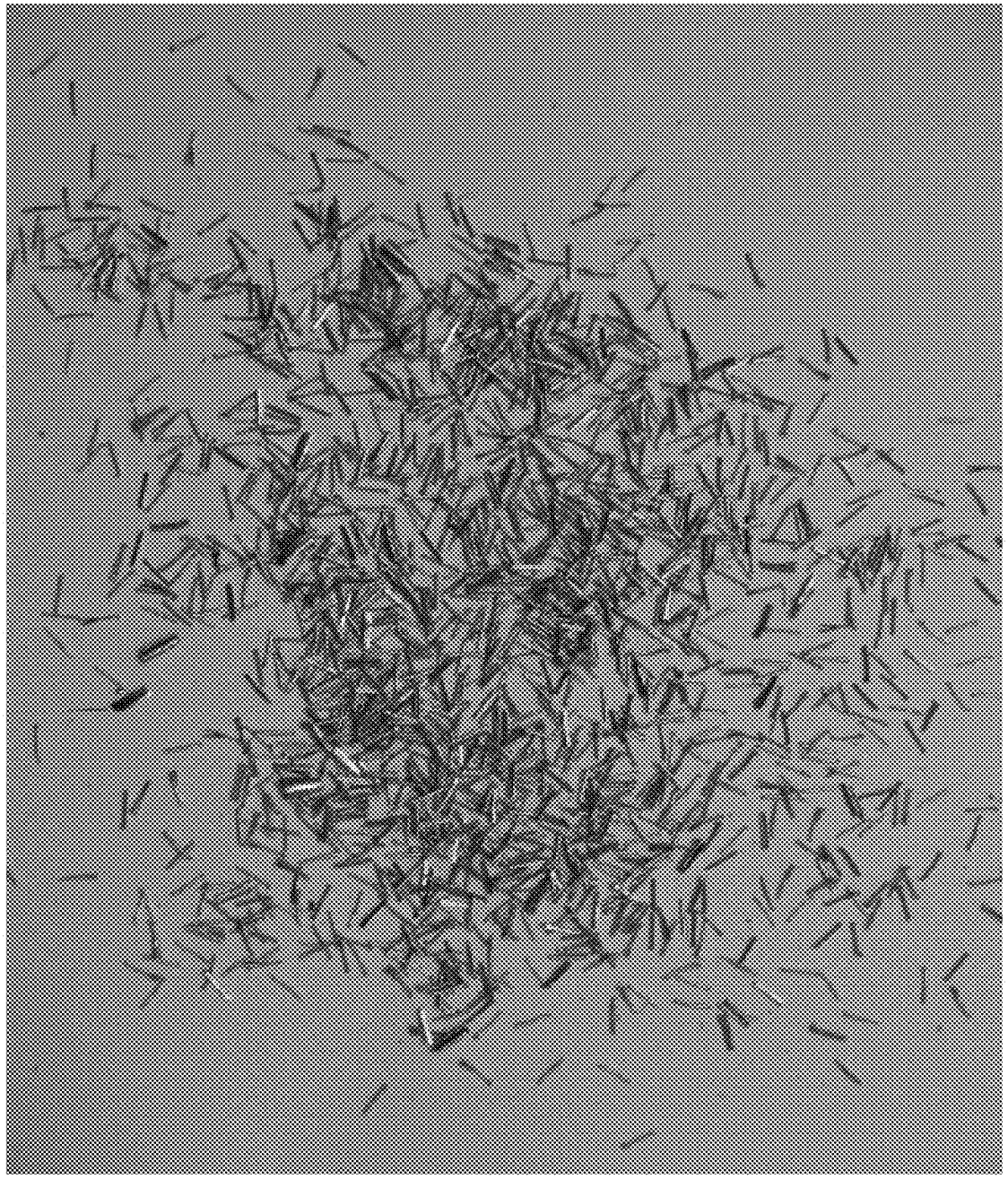

| Cutting speed/m · $min^{-1}$ | Example alloy 1 feeding quantity/mm · $r^{-1}$ | | | CuZn40Pb1Al0.6 feeding quantity/mm · $r^{-1}$ | | |
|---|---|---|---|---|---|---|
| | 0.1 | 0.2 | 0.3 | 0.1 | 0.2 | 0.3 |
| 40 | See FIG. 1A | See FIG. 1B | See FIG. 1C | See FIG. 1D | See FIG. 1E | See FIG. 1F |
| 60 | See FIG. 2A | See FIG. 2B | See FIG. 2C | See FIG. 2D | See FIG. 2E | See FIG. 2F |
| 80 | See FIG. 3A | See FIG. 3B | See FIG. 3C | See FIG. 3D | See FIG. 3E | See FIG. 3F |
| 100 | See FIG. 4A | See FIG. 4B | See FIG. 4C | See FIG. 4D | See FIG. 4E | See FIG. 4F |

4. Corrosion Resistance

All test samples are taken from low pressure die castings. The results are shown in Table 5.

Dezincification corrosion testing is carried out according to GB10119-1988 standard.

Stress corrosion testing is carried out according to GS0481.1.013-2005 standard.

Salt-spray corrosion testing is carried out according to ASTMB368-97 standard.

Release amount Value Q is measured according to NSF/ANSI61-2007 standard.

TABLE 5

Corrosion Test results of the examples and comparative alloy

| Examples | | 1 | 2 | 3 | 4 | 5 | 6 | 7 | CuZn40Pb1Al0.6 |
|---|---|---|---|---|---|---|---|---|---|
| Depth of dezincification layer/mm | Average value | 0.24~0.32 | 0.27~0.38 | | 0.25~0.33 | 0.24~0.31 | 0.23~0.28 | | 0.30~0.35 |
| | Maximum value | 0.43~0.50 | 0.47~0.55 | | 0.40~0.48 | 0.40~0.50 | 0.41~0.49 | | 0.45~0.51 |
| Stress corrosion | | Qualified | | | | | | | Qualified |
| Salt spray corrosion | | Qualified | | | | | | | Qualified |
| Release amount Value Q/μg/L | | Zn < 300, Bi < 50.0, Pb < 1.5, Sb < 0.6, Tl < 0.2, Cd < 0.5, As < 1.0, Hg < 0.2, All qualified | | | | | | | All qualified except for Pb > 5.0 |

5. Mechanical Properties

Tensile test samples are processed by low pressure die casting. Hardness test samples are processed by hand pouring. The test results are shown in Table 6.

TABLE 6

Mechanical properties of the examples and comparative alloy

| Examples | 1 | 2 | 3 | 4 | 5 | 6 | 7 | CuZn40Pb1Al0.6 |
|---|---|---|---|---|---|---|---|---|
| Tensile Strength/MPa | 378 | 365 | 380 | 430 | 410 | 442 | 445 | 370 |
| Elongation Rate/% | 7.5 | 9.5 | 11 | 16 | 14 | 16 | 17 | 10 |
| Hardness HRB | 69 | 62 | 61 | 57 | 72 | 70 | 70 | 55 |

What is claimed is:

1. A lead-free free-cutting aluminum brass alloy comprising: 57.0~63.0 wt % Cu, 0.3~0.7 wt % Al, 0.1~0.29 wt % Bi, 0.275~0.4 wt % Sn, 0.1-0.27 wt % Si, 0.01~0.15 wt % P, at least two elements selected from the group of 0.01-0.15 wt % Mg, 0.0016-0.0020 wt % B, 0.001-0.05 wt % rare earth elements and the balance being Zn and unavoidable impurities.

2. The lead-free free-cutting aluminum brass alloy of claim 1 comprising 0.4-0.6 wt % Al and 0.1-0.29 wt % Bi.

3. The lead-free free-cutting aluminum brass alloy of claim 1, wherein the impurities comprising ≦0.1 wt % Pb, ≦0.1 wt % Fe and ≦0.03 wt % Sb.

4. The lead-free free-cutting aluminum brass alloy of claim 2, wherein the impurities comprising ≦0.1 wt % Pb, ≦0.1 wt % Fe and ≦0.03 wt % Sb.

5. A manufacturing method for forming the alloy of claim 1, comprising: low pressure die casting at 980-1000° C.

6. A manufacturing method for forming the alloy of claim 2, comprising: low pressure die casting at 980-1000° C.

7. A manufacturing method for forming the alloy of claim 1, comprising: horizontal continuous casting with a mold forging temperature 650-710° C.

8. A manufacturing method for forming the alloy of claim 2, comprising: horizontal continuous casting with a mold forging temperature 650-710° C.

9. A lead-free free-cutting aluminum brass alloy comprising: 57.0~63.0 wt % Cu, 0.3~0.7 wt % Al, 0.1~0.29 wt % Bi, 0.275-0.4 wt % Sn, 0.31-0.5 wt % Si, 0.01~0.15 wt % P, at least two elements selected from the group of 0.01-0.15 wt % Mg, 0.0016-0.0020 wt % B, 0.001-0.05 wt % rare earth elements and the balance being Zn and unavoidable impurities.

* * * * *